US009783264B2

(12) United States Patent
deVries

(10) Patent No.: US 9,783,264 B2
(45) Date of Patent: Oct. 10, 2017

(54) MULTI-HULL VARIABLE ASPECT SURF RESCUE BOAT

(71) Applicant: Ben D. deVries, Palm Beach Gardens, FL (US)

(72) Inventor: Ben D. deVries, Palm Beach Gardens, FL (US)

( * ) Notice: Subject to any disclaimer, the term of this patent is extended or adjusted under 35 U.S.C. 154(b) by 0 days.

(21) Appl. No.: 15/180,714

(22) Filed: Jun. 13, 2016

(65) Prior Publication Data

US 2016/0362161 A1 Dec. 15, 2016

Related U.S. Application Data

(60) Provisional application No. 62/175,807, filed on Jun. 15, 2015.

(51) Int. Cl.

| | |
|---|---|
| ***B63B 1/14*** | (2006.01) |
| *B63B 3/08* | (2006.01) |
| *B63B 35/00* | (2006.01) |

(52) U.S. Cl.

CPC ..... *B63B 1/14* (2013.01); *B63B 2003/085* (2013.01); *B63B 2035/005* (2013.01)

(58) Field of Classification Search

CPC ..... B63B 2003/085; B63B 2035/005
USPC ..... 7/2
See application file for complete search history.

(56) References Cited

U.S. PATENT DOCUMENTS

| | | | | |
|---|---|---|---|---|
| 1,794,417 | A * | 3/1931 | Nador | B63B 1/121 114/354 |
| 3,866,557 | A * | 2/1975 | Lang | B63B 1/121 114/61.12 |
| 5,060,591 | A * | 10/1991 | Ciavarra | B63B 43/14 114/123 |
| 5,582,126 | A * | 12/1996 | Rypinski | B63B 1/125 114/352 |
| 6,698,371 | B1 * | 3/2004 | Stoltzfus | B63B 35/58 114/61.1 |
| 8,277,272 | B1 * | 10/2012 | Wemesfelder | B63B 1/14 114/61.16 |
| 2015/0314839 | A1 * | 11/2015 | Mauer | B63B 35/71 114/360 |

* cited by examiner

*Primary Examiner* — Christopher Harmon
(74) *Attorney, Agent, or Firm* — H. John Rizvi; Gold & Rizvi, P.A.

(57) ABSTRACT

A multi-hull variable aspect surf rescue boat is provided, which can support and contain occupant(s) and cargo and can be readjusted in shape and size to vary the boat's length overall (LOA), beam on center (BOC), the LOA/BOC ratio or OAR, thereby changing the boat's attitude, center of buoyancy and center of gravity without changing the boat's components or weight. The boat includes a frame assembly comprised of a centerline tube and three or more radiating, extendable and retractable telescoping tubes which intersect at a center line of the boat. A respective starling control assembly is attached to each telescoping tube, providing buoyancy to the boat. The frame assembly carries a platform for carrying the occupant(s) and cargo, and a means of propulsion for transporting the boat in surf or turbulent waterways.

8 Claims, 25 Drawing Sheets

Figure 1

| BOW Tube Strut Angle (10 to 70) = Stern Tube Strut Angle (10 to 70) | | | | | | | | | | | | |
|---|---|---|---|---|---|---|---|---|---|---|---|---|
| hypotenuse | BOW | | | | STERN | | | | OVERALL | | | |
| | sine | | cosine | | sine | | cosine | | | | | |
| strut | strut interior angle @ C/L | half craft length | half craft beam | half LOCHBD C | strut interior angle @ C/L | half craft length | half craft beam | half LOCHBD C | length | beam | loa/boc | stern/ bow symmetry |
| 6 | 10 | 5.91 | 1.04 | 3.67 | 10 | 5.91 | 1.04 | 3.67 | 11.82 | 1.04 | 11.34 | 1.00 |
| 6 | 15 | 5.80 | 1.55 | 3.73 | 15 | 5.86 | 1.55 | 3.73 | 11.59 | 1.55 | 7.46 | 1.00 |
| 6 | 20 | 5.64 | 2.05 | 2.75 | 20 | 5.64 | 2.05 | 2.75 | 11.28 | 2.05 | 5.49 | 1.00 |
| 6 | 25 | 5.44 | 2.54 | 2.14 | 25 | 5.44 | 2.54 | 2.14 | 10.88 | 2.54 | 4.29 | 1.00 |
| 6 | 30 | 5.20 | 3.00 | 1.73 | 30 | 5.20 | 3.00 | 1.73 | 10.39 | 3.00 | 3.46 | 1.00 |
| 6 | 35 | 4.91 | 3.44 | 1.43 | 35 | 4.91 | 3.44 | 1.43 | 9.83 | 3.44 | 2.86 | 1.00 |
| 6 | 40 | 4.60 | 3.86 | 1.19 | 40 | 4.60 | 3.86 | 1.19 | 9.19 | 3.86 | 2.38 | 1.00 |
| 6 | 45 | 4.24 | 4.24 | 1.00 | 45 | 4.24 | 4.24 | 1.00 | 8.49 | 4.24 | 2.00 | 1.00 |
| 6 | 50 | 3.86 | 4.60 | 0.84 | 50 | 3.86 | 4.60 | 0.84 | 7.71 | 4.60 | 1.68 | 1.00 |
| 6 | 55 | 3.44 | 4.91 | 0.70 | 55 | 3.44 | 4.91 | 0.70 | 6.88 | 4.91 | 1.40 | 1.00 |
| 6 | 60 | 3.00 | 5.20 | 0.58 | 60 | 3.00 | 5.20 | 0.58 | 6.00 | 5.20 | 1.15 | 1.00 |
| 6 | 65 | 2.54 | 5.44 | 0.47 | 65 | 2.54 | 5.44 | 0.47 | 5.07 | 5.44 | 0.93 | 1.00 |
| 6 | 70 | 2.05 | 5.64 | 0.36 | 70 | 2.05 | 5.64 | 0.36 | 4.10 | 5.64 | 0.73 | 1.00 |

MULTI-HULL VARIABLE ASPECT SURF RESCUE BOAT

CROSS-REFERENCE TO RELATED APPLICATIONS

This application claims priority to U.S. Provisional Application Ser. No. 62/175,807, filed Jun. 15, 2015, entitled "A multi-hull variable aspect ratio safety surfboat", the entire contents of which are incorporated by reference herein.

FIELD OF THE INVENTION

The present invention relates to the field of water craft, and particularly to a multihull variable aspect surf rescue boat to navigate ocean surf and turbulent waves.

BACKGROUND OF THE INVENTION

Surf and turbulent water have always been a danger to mariners and beachgoers. This invention is directed to addressing this long standing problem by improving on prior art.

Shallow draft rowing surf rescue boats that operate in surf and turbulent waterways have a particular advantage in using an open tubular chassis and frame, a payload platform, radially adjustable tube struts, and independent adjustable starling control assemblies. In certain embodiments, the invention provides a modular apparatus and methods to substantially reduce a vessel's wetted surface areas and total weight; to increase the operator's active control of the location and amount of vessel buoyancy forces as well as their orientation to the vessel's center line and amidships thereby better controlling the movements of the vessel's center of buoyancy, center of gravity, metacenter and its resulting righting moment; and to enable operator modification to accommodate the invention to local surf, tide, current, and waterway conditions better than prior art.

In general marine usage, the ratio of the craft's length overall (LOA) to its beam on center (BOC) line (LOA/BOC) is used to estimate the stability of vessels. For purposes of this application, Overall Aspect Ratio (OAR) will be used interchangeably with LOA/BOC and variable aspect will indicate the invention's ability to change the OAR as defined herein. Length overall, often abbreviated as LOA, is the maximum length of a vessel's hull measured parallel to the waterline. The beam of a ship is its width at the widest point as measured at the ship's nominal waterline.

The present invention operates with either a high or low OAR as selected by the operator. The present invention has multiple hulls (or flotation starlings) which are attached by radially angled struts that may be extended or retracted to vary the craft length and beam in relation to the craft's center line. The present invention is unique and superior to prior art watercraft in that its operator can vary both its length overall and its beam on center resulting in an OAR of 0.73:1 to 11:1 which provides the operator superior control in responding to varying waterway conditions.

In certain embodiments, the invention provides a modular apparatus and methods to substantially reduce a vessel's wetted surface areas and total weight; to increase the operator's active control of the location and amount of vessel buoyancy forces as well as their vector orientation to the vessel's center line amidships thereby better controlling the movements of the vessel's center of buoyancy, center of gravity, metacenter and its resulting righting moment; and to enable operator modification to accommodate the invention to local surf, tide, current, and waterway conditions better than prior art.

Where prior art outrigger canoe, catamaran and trimaran watercraft connect their outrigger, pontoon, float, or multi-hull with lateral beams to form a fixed, rectilinear geometry, the invention's modular flotation starlings, adjustable tube struts, radially adjustable chassis and frame components allow the invention to vary its buoyancy and its geometry.

When prior art surf boats traverse a short period, steep wave, they pitch forward, sideways or slide backward as their center of gravity crosses the wave peak which creates rapid rotation, then acceleration as the craft moves down the other side of the wave. When the present invention traverses similar short period, steep waves, the invention's novel construction allows the lifting forces to pass through the vessel superstructure and avoid the rapid acceleration forces and rotation experienced by prior art vessels. The invention embodying the improvements described below maintains a stable profile which more safely navigates similar turbulence and cresting waves than prior art craft and offers the operator novel and improved methods of craft operation and navigation.

BRIEF SUMMARY OF THE INVENTION

The ideal variable aspect surf rescue boat should be capable of varying both its OAR and buoyancy to suit varying local conditions of surf and turbulent waterway to save time, cost, effort, inconvenience and risk of loss caused by vessel capsize and severe movements.

It is a further object to minimize the total wetted surface areas of the variable aspect surf rescue boat exposed to wave lifting and rotational forces to increase the vessel's resistance to swamping and capsizing forces which occur in waves, beach launches, busy and turbulent waterways.

Another object of the invention is to provide a variable aspect surf rescue boat which is buoyant and stable even when the deck and interior has been filled with sea water.

Another object of the invention is to facilitate vessel transport, launch and recovery by ocean rescue personnel in emergency search and rescue efforts to safely retrieve and transport at-risk swimmers and boaters.

Another object is increase operator control and provide additional response alternatives to unexpected lift, rotational, and acceleration forces encountered by a vessel in waves and turbulent water conditions thereby improving the variable aspect surf rescue boat's overall safety, utility, comfort, and performance.

Another object is to provide a selectable sliding oar rig or sliding seat rowing option to improve speed over bottom by reducing heaving and pitching in the variable aspect surf rescue boat.

Attempts to provide variable aspect surf rescue boats of this type in the past have resulted in a structure that is both expensive and complicated. These and other difficulties experienced with the prior art devices have been obviated in a novel manner by the present invention.

With these and other objects in view, as will be apparent to those skilled in the art, the invention resides in the combination of parts set forth in the specification and covered by the claims appended hereto.

BRIEF DESCRIPTION OF THE DRAWINGS

FIG. 1 shows the estimated LOA/BOC ratio or OAR variation by combining the bow OAR and stern OAR at various interior radial angle orientation amidships the craft center line thereby varying the OAR for the first preferred embodiment shown in FIG. 2.

FIG. 2 shows a perspective view from above the starboard stern of a quad-vector strut variable aspect surf rescue boat (101) comprising four flotation control assemblies or starling control assemblies (110), four telescoping tubular struts (120), two symmetrical and receiving, bow chassis tubes (130), and two symmetrical and receiving, stern chassis tubes (140).

FIG. 3 shows a top view of the preferred embodiment showing the variable aspect surf rescue boat's structural components with only one flotation starling (112), four telescoping tubular struts (120), twin bow chassis tubes (130), twin stern chassis tubes (140), twin bow flotation control brackets (111), twin box beams (151), twin stern flotation control brackets.

FIG. 4 shows a front view of a starling control assembly (110) constructed of a control riser post top cap (116), control riser post (117), top control plate, horizontal brace and riser locking posts (128), large flotation starling (112), small flotation starling (113), bottom control plate (114), and control riser post keel cap (115).

FIG. 5 shows a perspective view of FIG. 4 from the vessel side of a starling control assembly (110) shown without its flotation starling(s). Each starling control assembly consists of one or more control riser post top cap(s) (116), control riser post(s) (117), top control plate, horizontal brace and riser locking posts (s) (118), bottom control plate(s) (114), and control riser post keel cap(s) (115). In this instance, two control risers are inserted into two tubular penetrations through each flotation starling. The control post acts to control the starling's vertical, lateral, and horizontal orientation.

FIG. 6 shows a top view of FIG. 3 showing a large flotation starling (112), top control plate, horizontal brace and riser locking posts (118), and the control riser post top cap (116). Each flotation starling has two through-hull cylindrical tubes below the control riser post top caps (116) that penetrate the starling and receive the control riser posts.

FIG. 7 shows a bottom view of FIG. 4 showing a large flotation starling (112), small flotation starling (113), bottom control plate (114), and a control riser post keel cap (115).

FIG. 8 shows a top view of the bow flotation control bracket (111), made of two control riser posts (117) and top control plate, horizontal brace and riser locking posts (118), that transfers flotation forces and structural loads from the struts to the starling control assembly, and a strut locking post (111.*c*).

FIG. 9 shows a side view of FIG. 8.

FIG. 10 shows a perspective view of the chassis and frame and payload platform from above the stern of the deck (152), cage post (154), cage rail (155), rowing box rail (166), sliding truck (164), box rail trestle posts (165), attached to the box beam (151), stern chassis spine tube (136), bow chassis tubes (130), stern chassis tubes (140) and telescoping tubular struts (120).

NAMES AND THE CORRESPONDING REFERENCE NUMBERS AND/OR CHARACTERS

Figure 2:
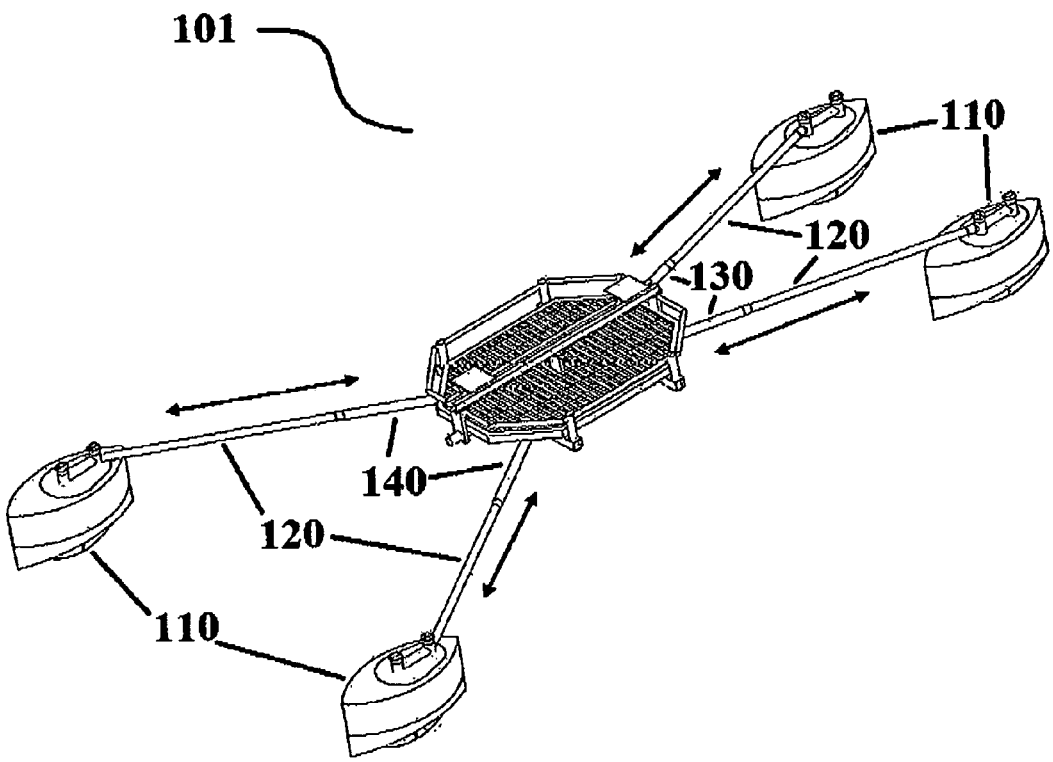
FIG. 2 through 10 are views of the first preferred embodiment.

| NO. | NAME/DESCRIPTION |
|---|---|
| 101 | Quad-vector strut variable aspect surf rescue boat |
| 102 | Tri-vector strut variable aspect surf rescue boat |
| 103 | Two-man hex-vector strut variable aspect surf rescue boat |
| 110 | Starling control assembly |
| 111 | Bow flotation control bracket |
| 111.c | Strut locking post |
| 112 | Flotation starling |
| 113 | Flotation starling |
| 114 | Bottom control plate |
| 115 | Control riser post keel cap |
| 116 | Control riser post top cap |
| 117 | Control riser post |
| 118 | Top control plate, horizontal brace and riser locking posts |
| 120 | Telescoping tubular strut |
| 122 | Cross brace strut |
| 123 | Stern chassis arch tube |
| 124 | Bow chassis arch tube |
| 130 | Bow chassis tube |
| 135 | Bow chassis spine tube |
| 136 | Stern chassis spine tube |
| 137 | Chassis spine tube |
| 140 | Stern chassis tube |
| 150 | Chassis and frame payload platform assembly |
| 151 | Box beam |
| 152 | Deck |
| 154 | Cage post |
| 155 | Cage rail |
| 160 | Rowing rail propulsion assembly |
| 161 | Oar rig |
| 162 | Rowing seat |
| 164 | Sliding truck |
| 165 | Box rail trestle post |
| 166 | Rowing box rail |
| 200 | Adjustable variable vector chassis hub assembly |
| 201 | Hub chassis receiving spoke |
| 202 | Variable vector hub bottom plate |
| 203 | Variable vector hub top plate |
| 204 | Chassis spine to hub locking pin slot |
| 205 | Spoke rotating axle |
| 206 | Chassis spine tube opening |
| 207 | Chassis spine tube support trunk |

-continued

NAMES AND THE CORRESPONDING REFERENCE NUMBERS AND/OR CHARACTERS

| NO. | NAME/DESCRIPTION |
|---|---|
| 208 | Spoke axle locking gear |
| 209 | Gear locking plate |
| 300 | Double elliptical ring compression frame |
| 301 | Frame connecting tubes |
| 302 | Bottom compression elliptical ring tube |
| 303 | Top compression elliptical ring tube |
| 304 | Compression connection bracket |

DETAILED DESCRIPTION AND BEST MODE OF IMPLEMENTATION

Description of the Preferred Embodiment

In a preferred embodiment, a frame, deck, cage, and grate are supported by the vector chassis to form an enclosure that contains occupants, loads and the propulsion assembly. The vector chassis and frame elevate the variable aspect surf rescue boat's deck, grate and payload cage above the surface of the water [FIGS. 2, 12, 13, 15 and 18]. When the rowing propulsion assembly component is used, the bow starling control assembly pair can be positioned out of the reach of the sweep of the oar(s). For illustration, this quad vector variable aspect surf rescue boat has a pair of bow flotation control brackets, each bracket having a symmetrical horizontal obtuse angle of 163 degrees and a pair of stern flotation control brackets each with a symmetrical horizontal obtuse angle of 146 degrees to orient the center line of the four flotation assemblies in parallel. In this example, the vector chassis tube sleeves connect with the bow flotation control brackets (111) pair at an interior angle of 163 degrees which is supplementary to the interior angle of the bow chassis tube's (130) intersection to the bow chassis spine tube (135) of 17-degree angle. The stern control bracket (111) has an interior angle of 146 degrees which is supplementary to the 34-degree angle of the stern chassis tube's (140) intersection to the stern chassis spine tube (136).

The invention's tubular open multihull, tube strut, chassis and frame payload platform reduces surface resistance to wave fronts when compared to prior art which allows a wave's energy to dissipate without causing unwanted movement of the vessel when compared with prior art. By reducing the vessel's wetted surface profile, the craft offers the least possible resistance to wave energy movements not coincident with the direction of travel; reduces the energy required to propel, stabilize and control the craft; and improves the performance, safety and handling ability of the vessel. At wave lengths shorter than the overall length of the craft, the open frame will allow a wave to lift one starling control assembly independently of another thereby reducing the overall rotation forces acting on the vessel occupants and payload.

Use of an open, structural tube frame minimizes hull plane surfaces at the waterline subject to lifting forces resulting in reduced power and fuel requirements when compared to prior art to propel the craft and to navigate waves and surf. By reducing hull surfaces and water plane areas per craft load capacity, the weight and material of the craft results in cost reductions to construct, transport, operate, and store the vessel. By reducing the water plane area exposed to wave and wind action, launch speed, safety, and maneuverability of emergency ocean search is improved.

The invention's adjustable OAR component system can be configured as a high OAR or low OAR providing the operator additional flexibility when compared to prior art craft. Since a larger OAR indicates a slimmer hull, it is used as an approximate guide of relative stability and speed in watercraft design. This usually implies less wave-making resistance, and thus more efficient high-speed performance, but also suggests reduced load-carrying ability for a given length and greater instability.

Figure 15:
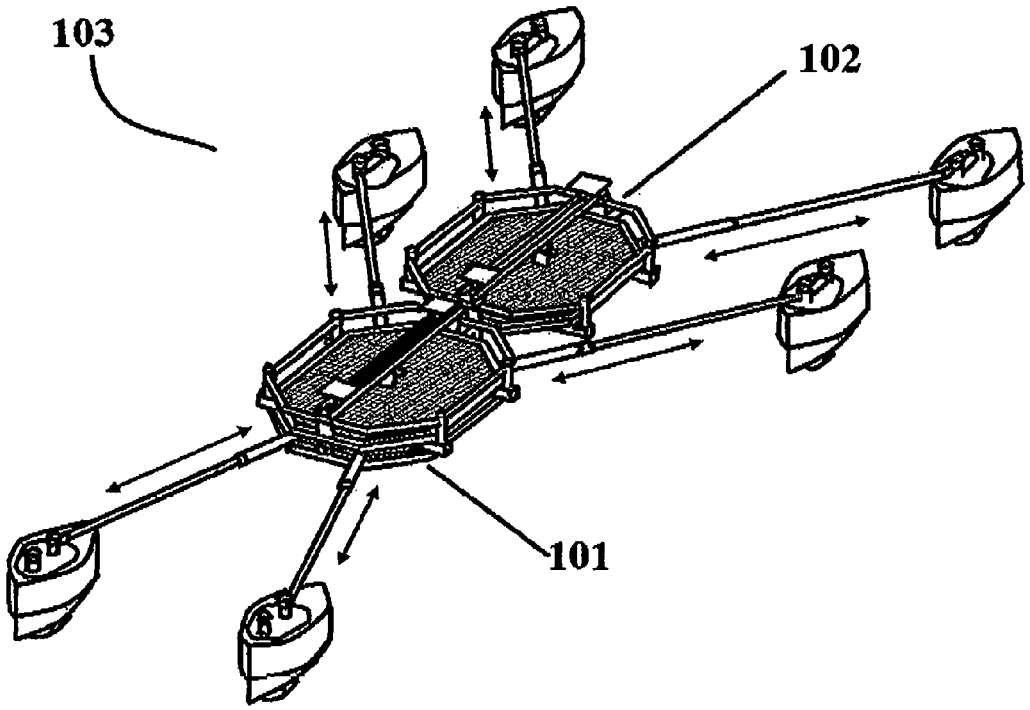
FIG. 15 shows a perspective view of the third preferred embodiment from above the starboard bow of a two-man hex-vector strut variable aspect surf rescue boat (103) constructed by combining the components of a quad-vector strut variable aspect surf rescue boat (101) and a tri-vector strut variable aspect surf rescue boat (102).
Figure 16:
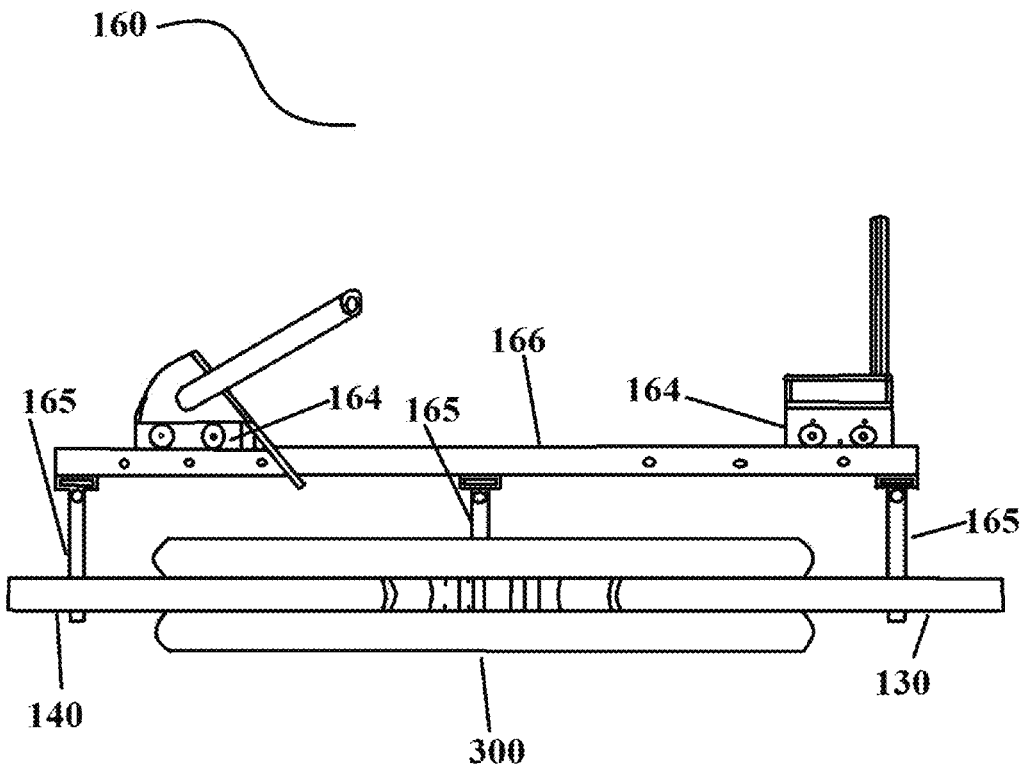
FIG. 16 shows a side view of a rowing rail propulsion assembly (160) showing two selectable, sliding trucks (164) riding on a rowing box rail (166) that is connected by three box rail trestle posts (165) to the vector chassis spine tube. Also shown are the deck (152), cage post (154), stern chassis tube (140) that carry the seat and rowing rig and transfer the propulsion and flotation forces.

Modular vector chassis, payload cage and deck components can be connected in series and/or parallel to provide for multiple payload platforms, multiple rowers, additional occupants and loads, as in the third preferred embodiment (FIG. 15). The vector chassis, cage and deck can also receive one or more of the following propulsion assemblies: a rowing rail (FIGS. 2, 10, 12, 15, 16, 17, 18 and 19); a sail with mast; a powered motor with air propeller(s), water propeller(s), water jet, and or air jet.

This invention allows the user to reconfigure a craft simply, safely and quickly to accommodate various uses, weather, current, wind, waterway terrain, and water conditions. The modular component system can be manufactured using 3D printing to reduce delivery times and costs required construct and to deploy the vessel. The modular design can readily be scaled up or down in size to accommodate custom sizes and uses including youth boat and life safety training, physical rehabilitation, surfboat training, search and rescue efforts, or as a reduced sized unmanned surface vessel for water survey and research.

The invention is made using the latest fabrication techniques from wood, aluminum, aluminum magnesium alloy, stainless steel, graphene, titanium, copper, multiple layer fiberglass, wood, polycarbonate, fiberglass reinforced pultrusion (FRP), ABS, graphene, carbon fiber, high strength polymers or other high strength light weight material. The components and parts are connected by corrosion resistant marine cabling, rigging hardware, cable railing system, turnbuckles, collars, pins, rigging screws, shackles, marine hardware, thimbles, snap hooks, and quick links.

Figure 3:
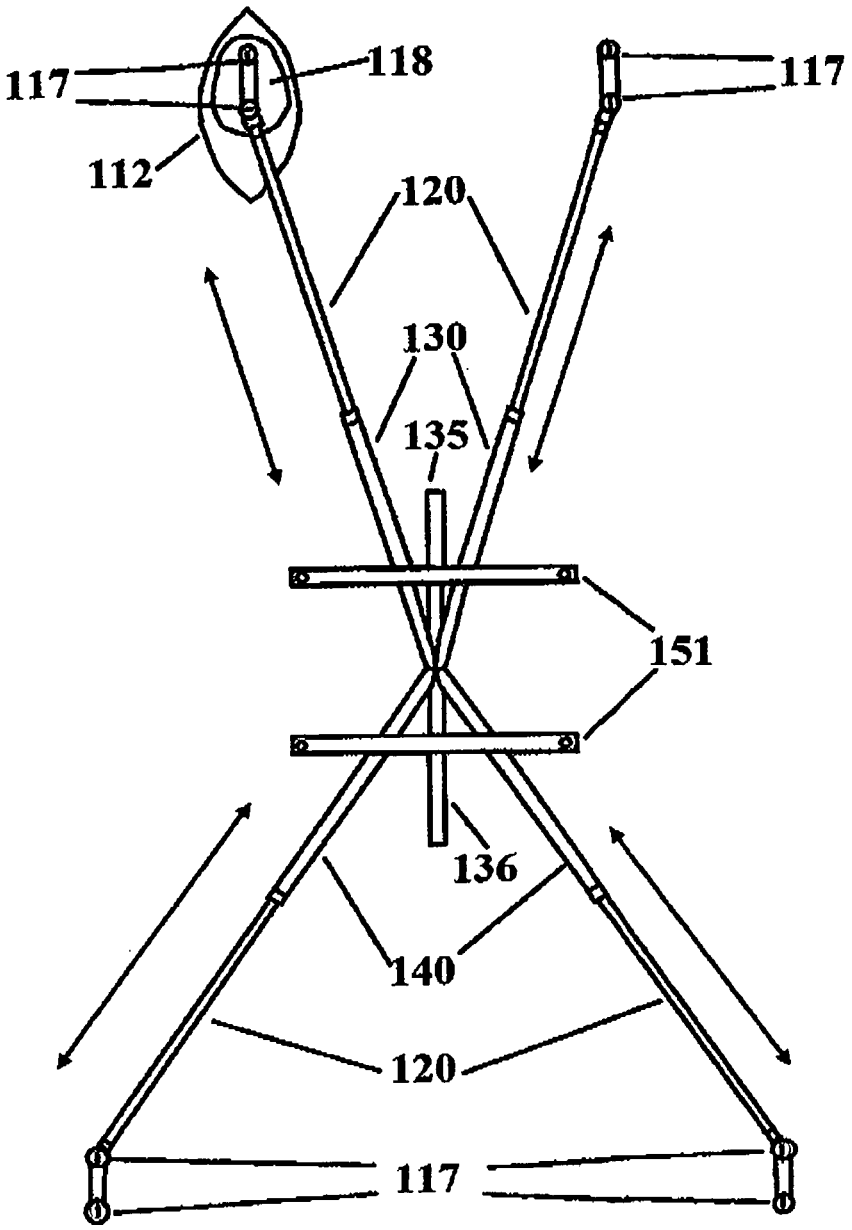

The main component assemblies are constructed as follows:

1. VECTOR CHASSIS AND FRAME PAYLOAD PLATFORM. The vector chassis element forms the backbone of the variable aspect surf rescue boat's structure (FIG. 3). The vector chassis includes:

1) Chassis constructed as either fixed bow, stern and spine intersecting receiving tubes or an adjustable variable vector chassis hub assembly with spokes that rotate to adjust the incident angle of each of the chassis receiving tubes.

Figure 17:
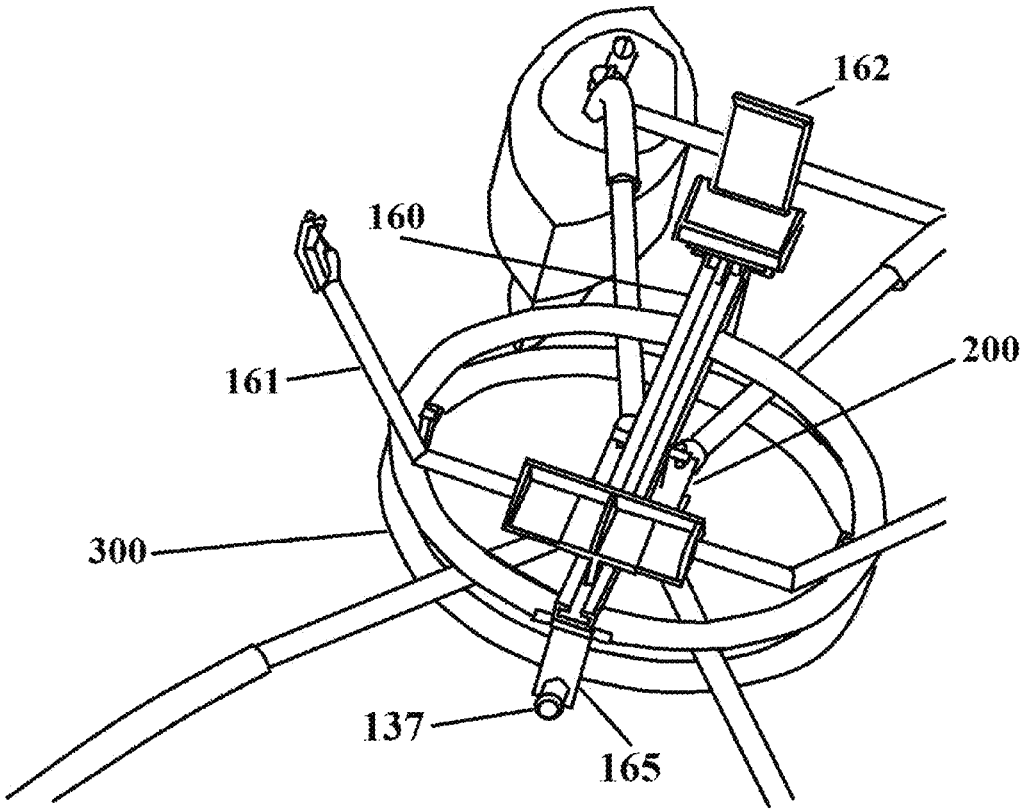
FIG. 17 shows a perspective view from above the starboard stern of a double elliptical ring compression frame (300), adjustable variable vector chassis hub (200), a rowing rail propulsion assembly (160) including a oar rig (161) and a rowing seat (162) mounted on two selectable, wheeled trucks.
Figure 18:
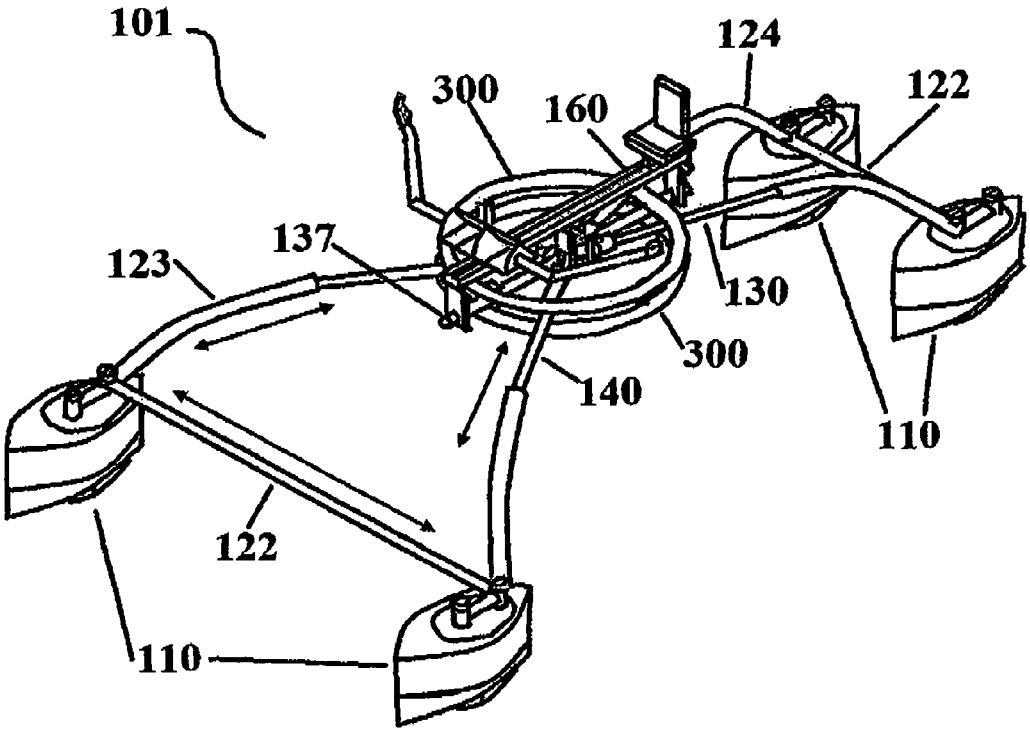
FIG. 18 shows a perspective view of the fourth embodiment from above the starboard stern of a quad-vector strut variable aspect surf rescue boat (101) with rowing rail propulsion assembly (160) and an adjustable variable vector chassis hub assembly (200) with one telescoping stern cross brace strut (122) that connects the two stern starling control assemblies (110), two symmetrical stern chassis arch tubes (123) that connect the starling control assemblies to the two stern chassis receiving tubes, one telescoping bow cross brace strut (122) that connects the two bow starling control assemblies (110), two symmetrical bow chassis arch tubes (124) that connect the starling control assemblies to the two bow chassis receiving tubes.
Figure 25:
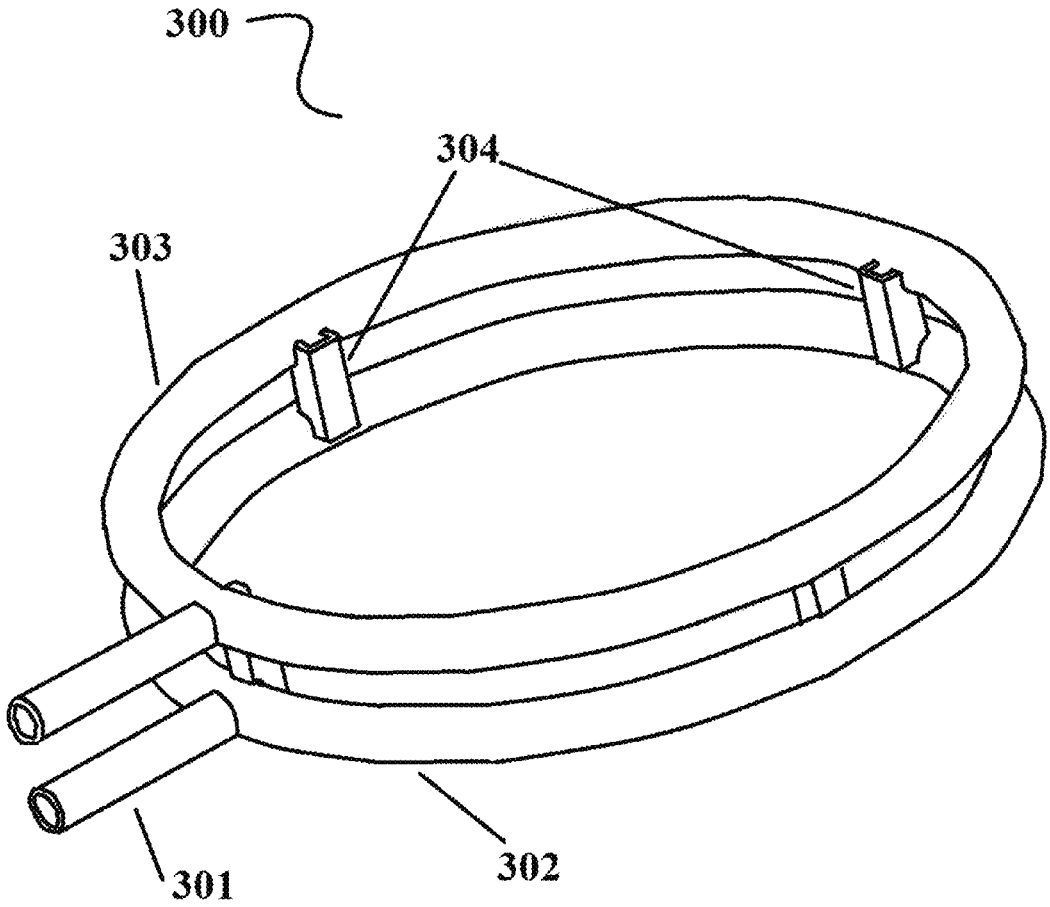
FIG. 25 shows the top perspective view of a double elliptical ring compression frame (300) constructed with frame connecting tubes (301), bottom compression elliptical ring tube (302), top compression elliptical ring tube (303), four compression connection brackets (304).

2) Frame made of a box beam frame (FIGS. 10, 11, 12, 13) or double elliptical ring compression frame (FIGS. 17, 25).

3) Deck constructed of pervious or impervious grate or webbing.

4) Cage constructed of tube or rod rails and posts.

5) Connectors and fittings made of marine hardware, ABS, alloy metal or nylon to resist corrosion.

This invention has multiple tubes and each is secured to an adjoining tube and locks in a position relative thereto. A vector chassis (FIGS. 3, 10, 11, 12, 13, 14, 17, 18, 19, 20) of intersecting tubes forms the backbone of the variable aspect surf rescue boat's structural frame. One or more pairs of bow and stern angled receiving tubes are connected at the craft's center line spine tube to form a foci of vectors.

The vector chassis receiving tubes that radiate from the chassis and frame centerline and connects to the tube struts thereby transferring loads and forces between the propulsion assembly, the payload platform and the flotation starling control assemblies. A box frame or elliptical frame with penetrations and slots for the chassis tubes acts to stiffen and reinforce the chassis and transfer and balance tension, compression, shear, bending and torsion forces resulting from structural load, propulsion, and buoyancy forces acting on the craft when stationary or under way without buckling, snapping, or delaminating.

The vector chassis and the frame are held rigid by brackets, rivets, welds, and marine hardware. In the fixed chassis and box frame, the craft's OAR is only changed by manual replacement, extension and retraction of the tube strut assemblies.

An optional deck and cage sits on and is connected to the chassis and frame to support and contain the variable aspect surf rescue boat's occupants and payload.

In an alternative embodiment having an adjustable variable vector chassis hub assembly (FIGS. 20-24), the axle of each rotating spoke is adjusted to the desired angle then the spoke axle locking gear (208) is immobilized by the gear locking plate (209). A hub locking pin is then inserted vertically through chassis spine to hub locking pin slot (204), gear locking plate (209), variable vector hub top plate (203), chassis spine tube opening (206), bow and stern chassis spine tubes (135, 136), chassis spine tube support trunk (207), spine tube (137), and variable vector hub bottom plate (202). In a preferred embodiment, the variable vector chassis hub assembly replaces the gear locking plate (209) with worm gear box and motor that engages the spoke axle locking gear (208) to control and fix the angle of the rotating spokes.

The tube shape of the struts allows for ease of connecting components from the elements. The double elliptical ring compression frame (300) and adjustable variable vector chassis hub assembly (200) when used together give the operator the option to change the angle of each chassis receiving tubes relative to the craft's center line up to almost ninety (90) degrees.

Figure 4:
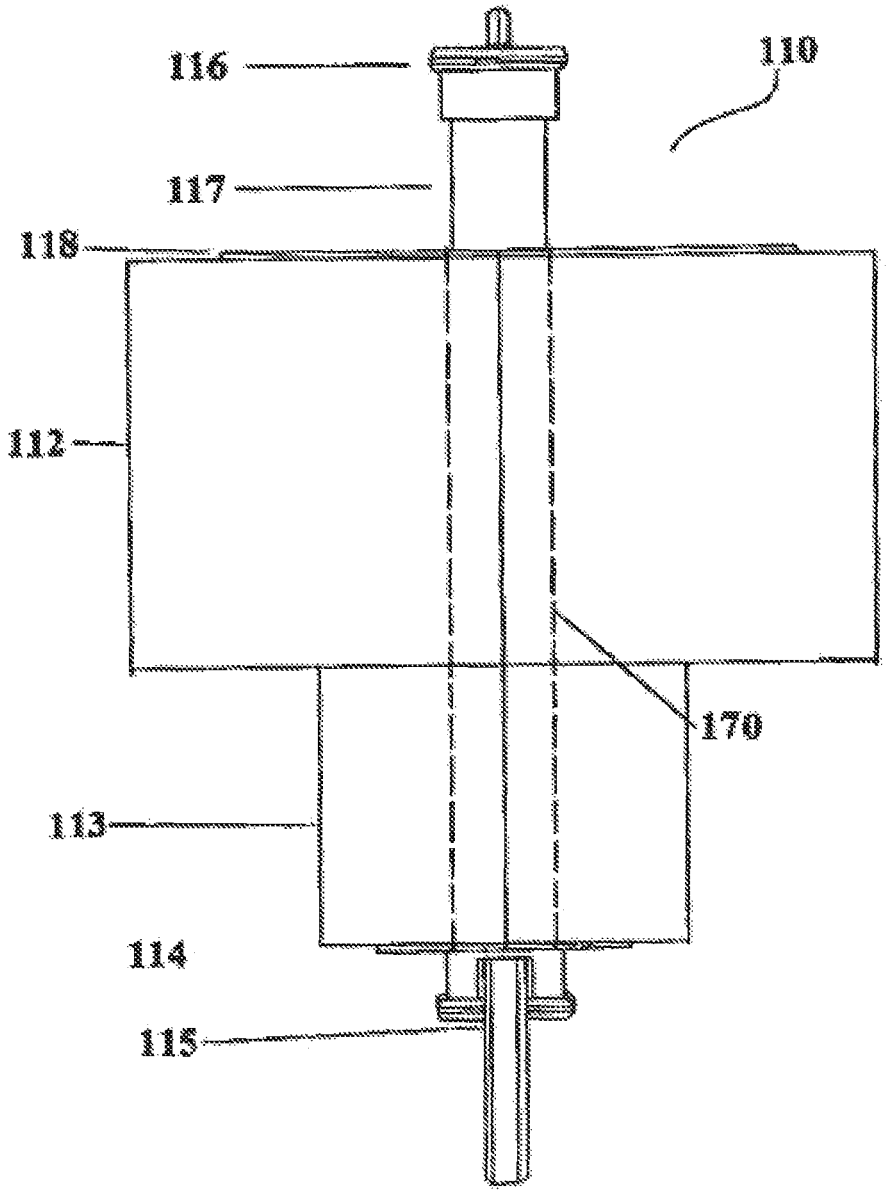

2. FLOTATION STARLING CONTROL ASSEMBLY. The flotation starling control assembly (FIG. 3) consists of one or more flotation starlings (112, 113), one or more control riser post (117), a bottom control plate (114), a bottom, control riser post keel cap (115), top control plate, horizontal brace and riser locking posts (118), and one or more strut connectors (119) with fixed pin and/or rotating collar and pin locking connectors. Each flotation starling has one or more tubular penetrations from top to bottom or side to side that receives a control riser post (117) of similar dimensions (FIGS. 4 and 5).

Figure 19:
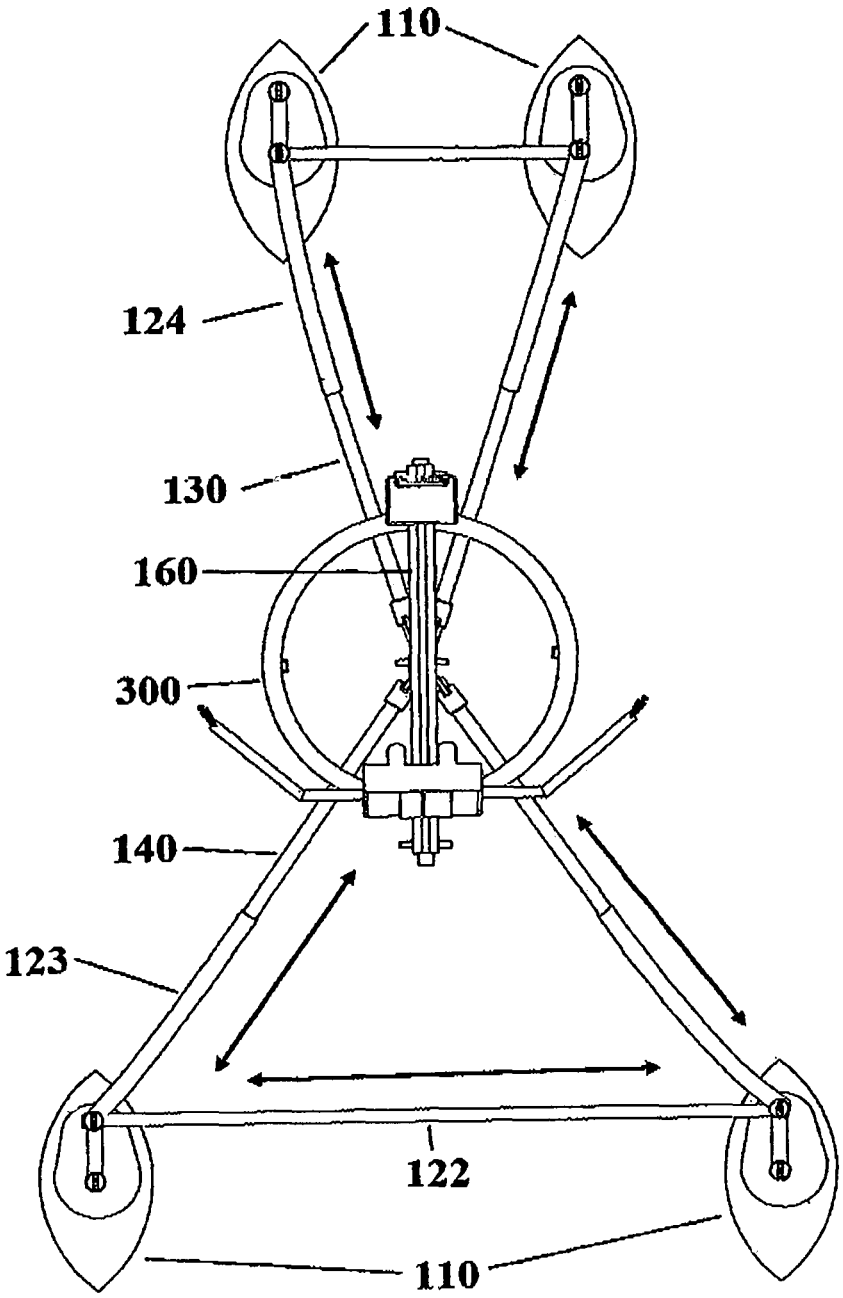
FIG. 19 shows a top view of FIG. 18 with four starling control assemblies (110), two telescoping cross brace struts (122), two symmetrical stern chassis arch tubes (123), two symmetrical bow chassis arch tubes (124), rowing rail propulsion assembly (160), adjustable variable vector chassis hub assembly (200), and double elliptical ring compression frame (300).
Figure 20:
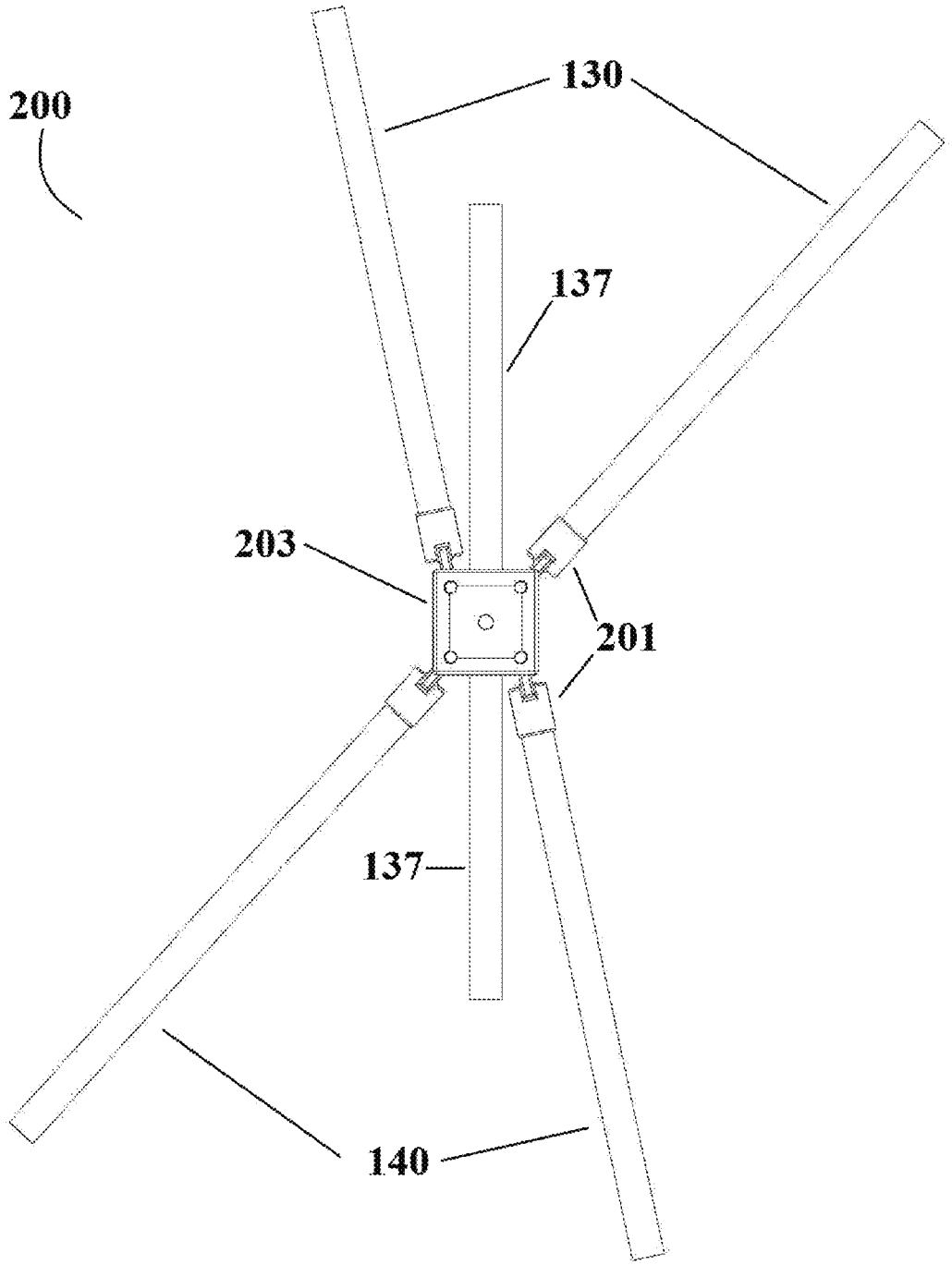
FIG. 20 shows a top view of an adjustable variable vector chassis hub assembly (200), twin bow chassis tubes (130), bow chassis spine tube (135), stern chassis spine tube (136), twin stern chassis tubes (140), four hub chassis receiving spokes (201), and variable vector hub top plate (203).
Figure 21:
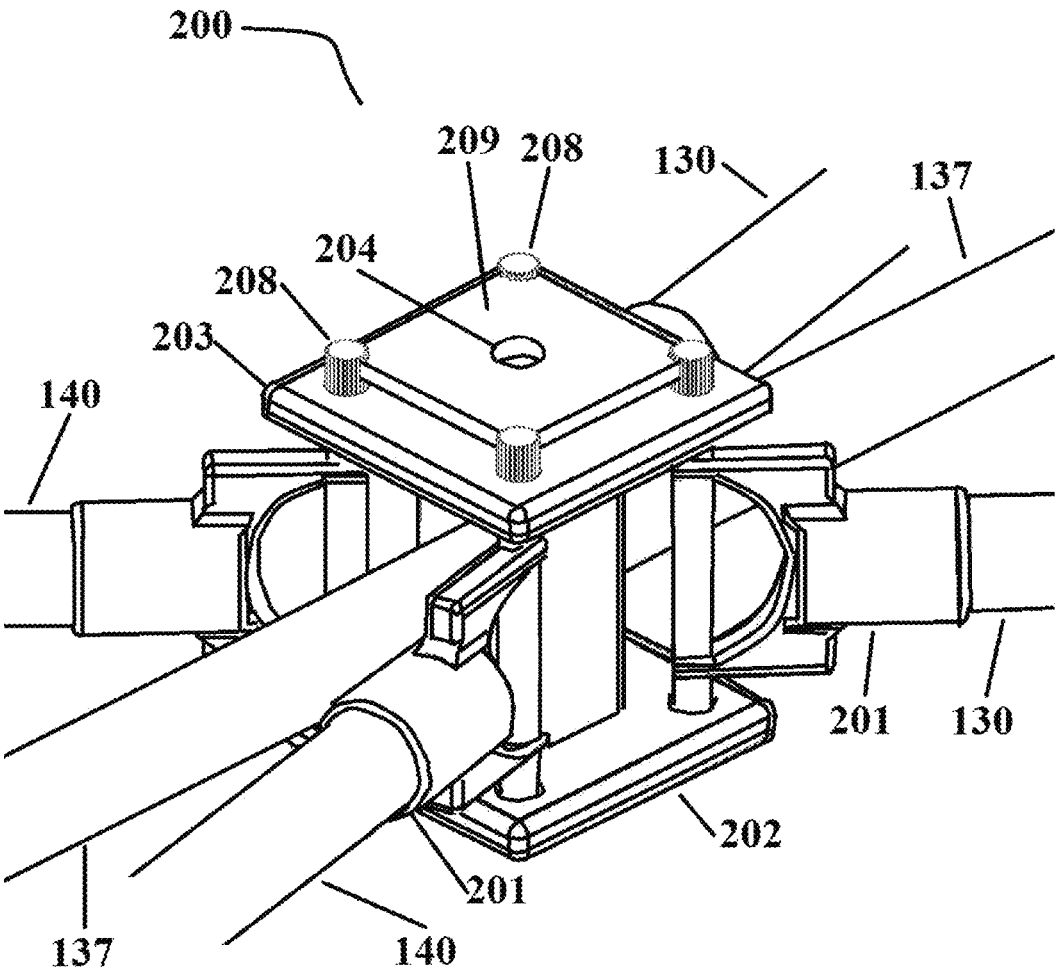
FIG. 21 shows a perspective view of an adjustable variable vector chassis hub assembly (200), twin bow chassis tubes (130), bow chassis spine tube (135), stern chassis spine tube (136), twin stern chassis tubes (140), two hub chassis receiving spokes (201), variable vector hub bottom plate (202) and top plate (203), chassis spine to hub locking pin slot (204), spoke axle locking gear (208), gear locking plate (209).
Figure 22:
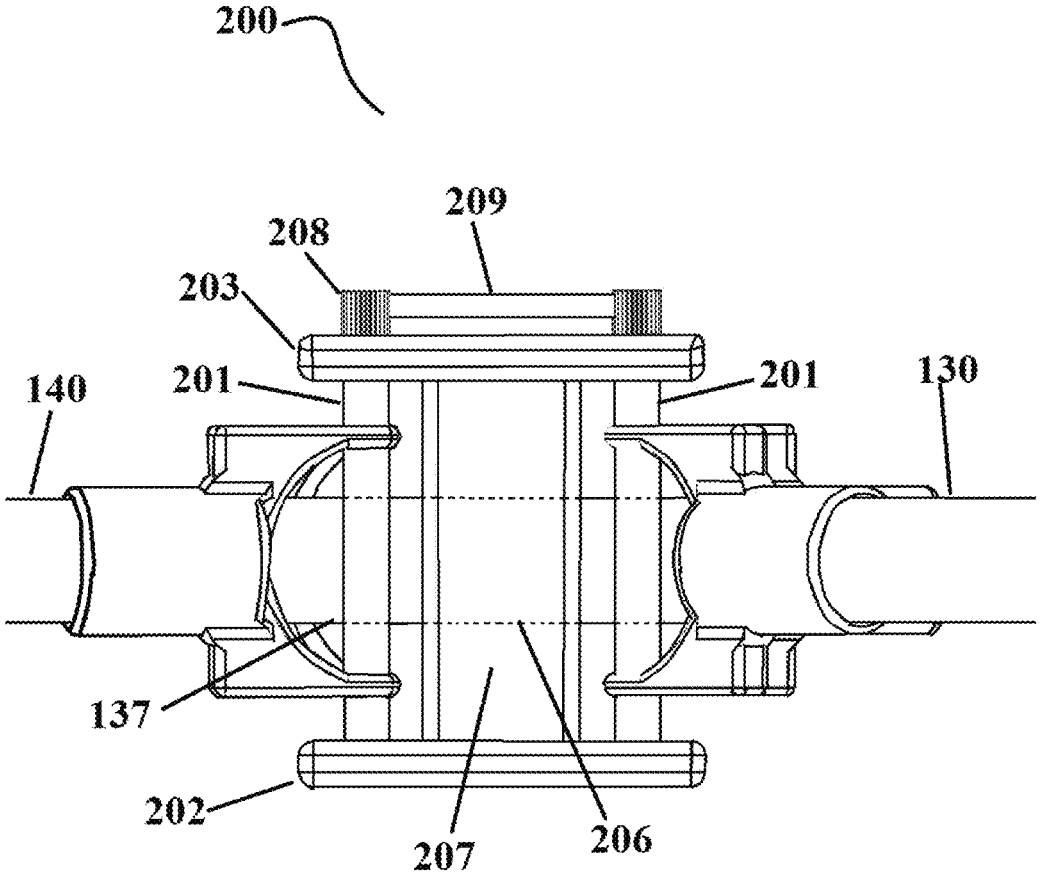
FIG. 22 shows a side view of an adjustable variable vector chassis hub assembly (200), bow chassis tube (130), stern chassis tube (140), four hub chassis receiving spokes (201), variable vector hub bottom plate (202) and top plate (203).
Figure 23:
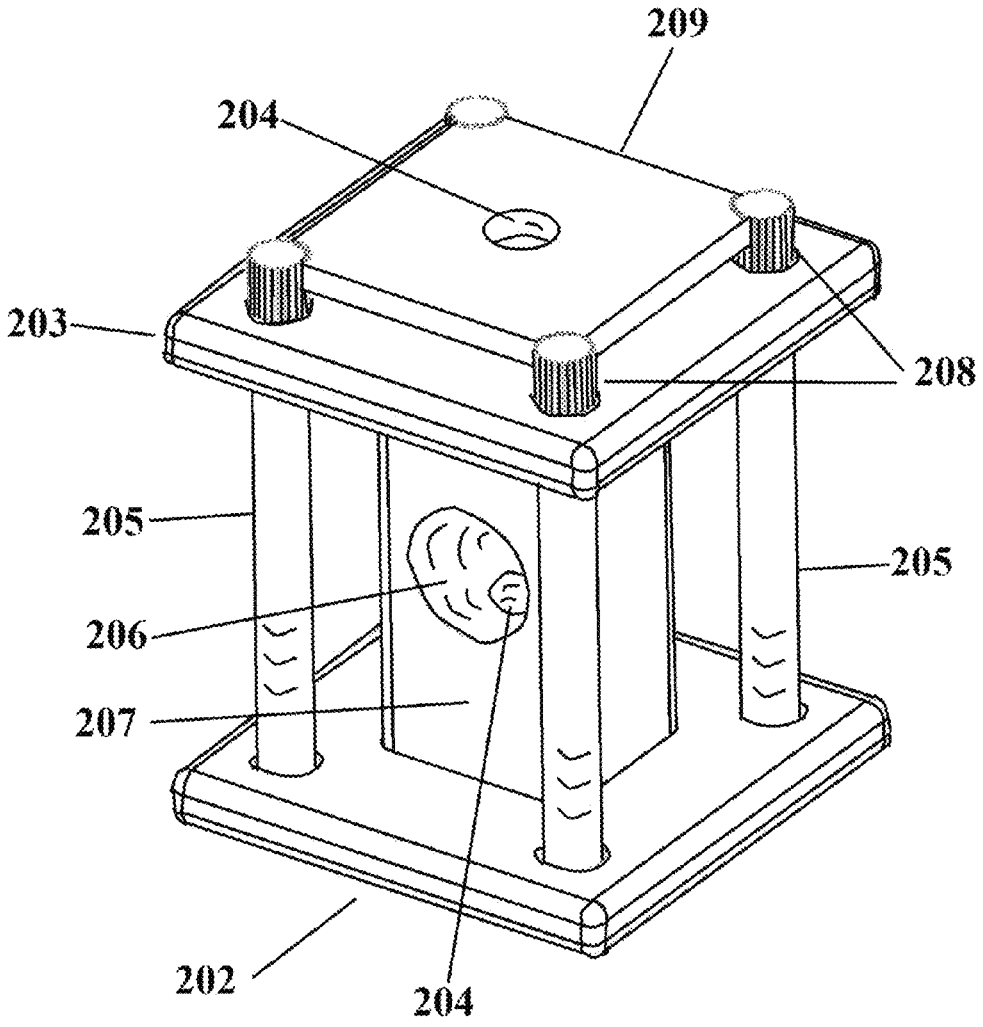
FIG. 23 shows a perspective interior view of a variable vector hub, variable vector hub bottom plate (202) and top plate (203), chassis spine to hub locking pin slot (204), three spoke rotating axles (205), and chassis spine tube opening (206), four spoke axle locking gears (208), and gear locking plate (209).
Figure 24:
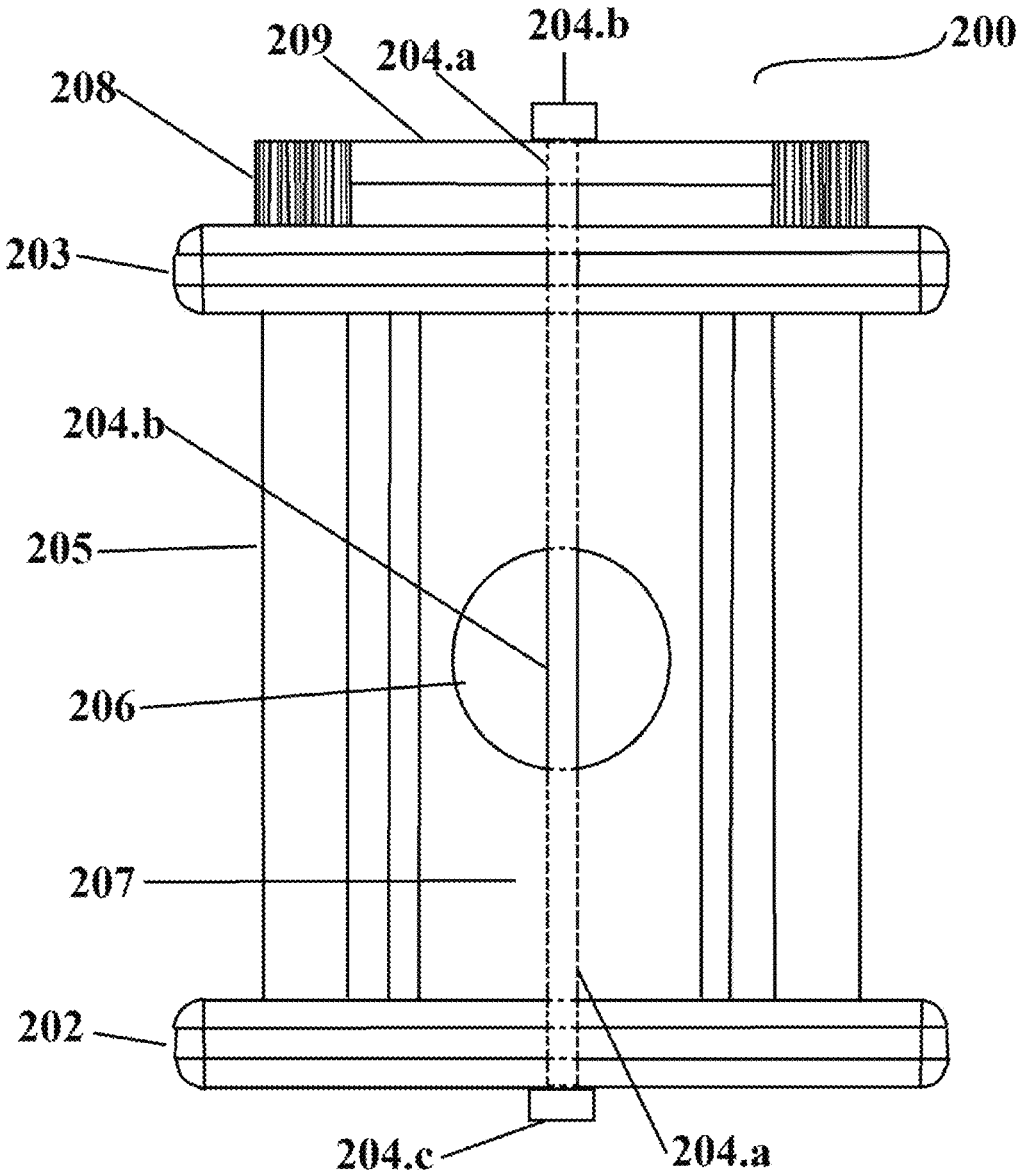
FIG. 24 shows a side interior view of a variable vector hub assembly (200), variable vector hub bottom plate (202) and top plate (203), three spoke rotating axles (205), chassis spine tube opening (206), chassis spine tube support trunk (207), four spoke axle locking gears (208), and gear locking plate (209).

Each flotation starling control assembly has a control bracket (111) to receive one or more control riser post(s) (117) and a bottom control plate (114) or flange which together lock the assembly's flotation starling(s) in place and connects the starling control assembly to a bow, stern or cross brace structural load bearing strut (FIGS. 3 and 19).

Figure 5:
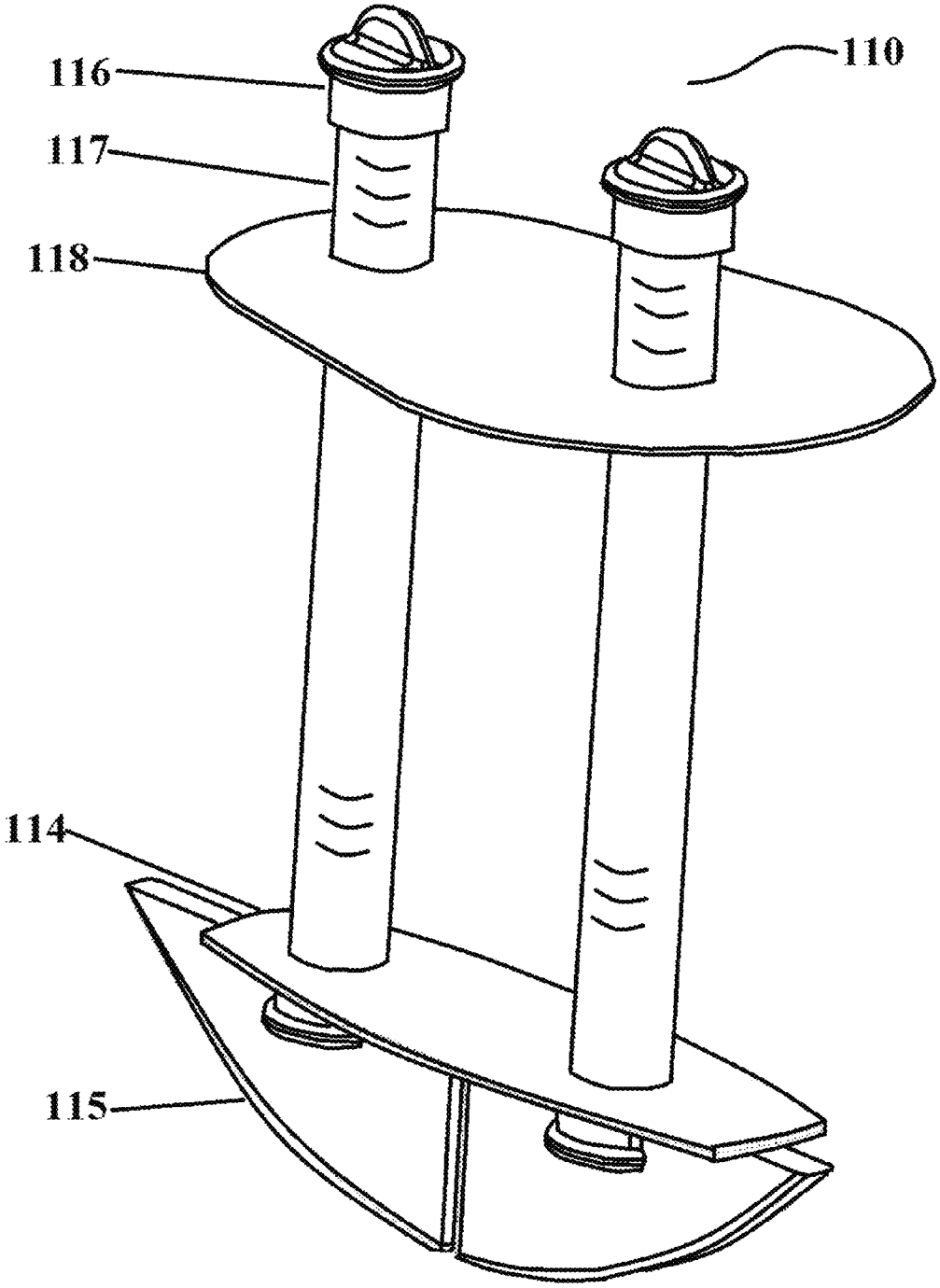
Figure 6:
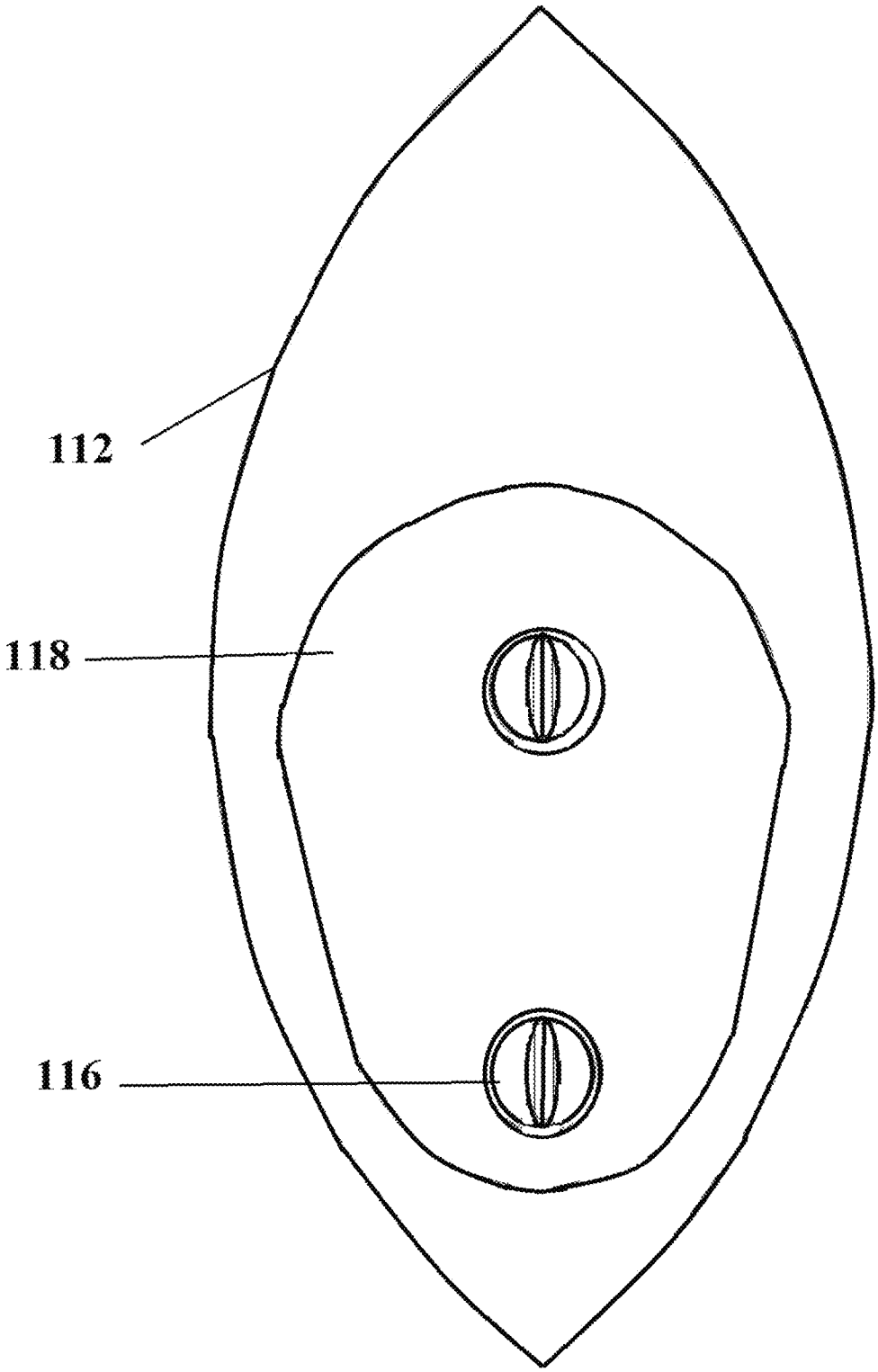
Figure 7:
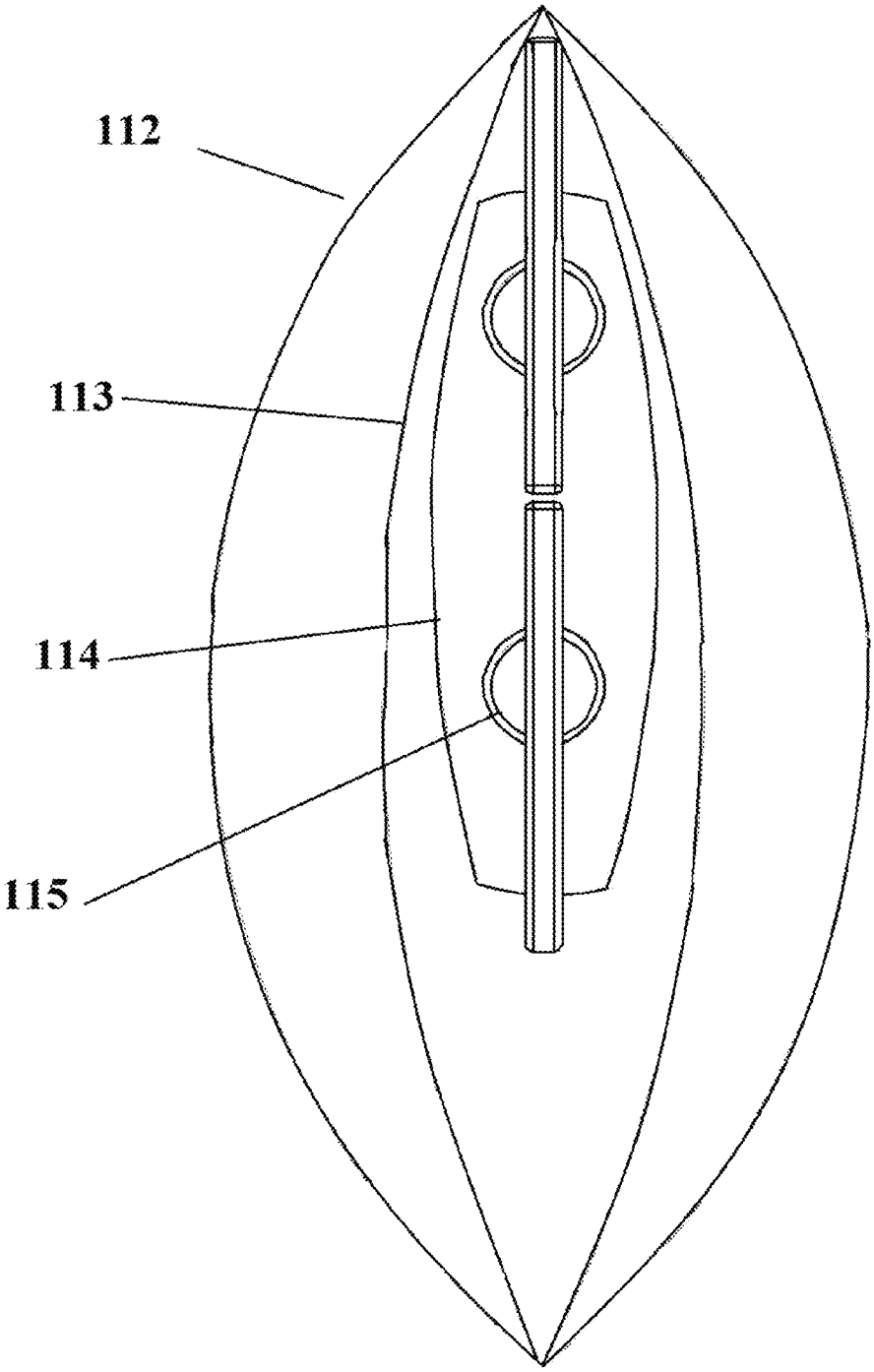
Figure 8:
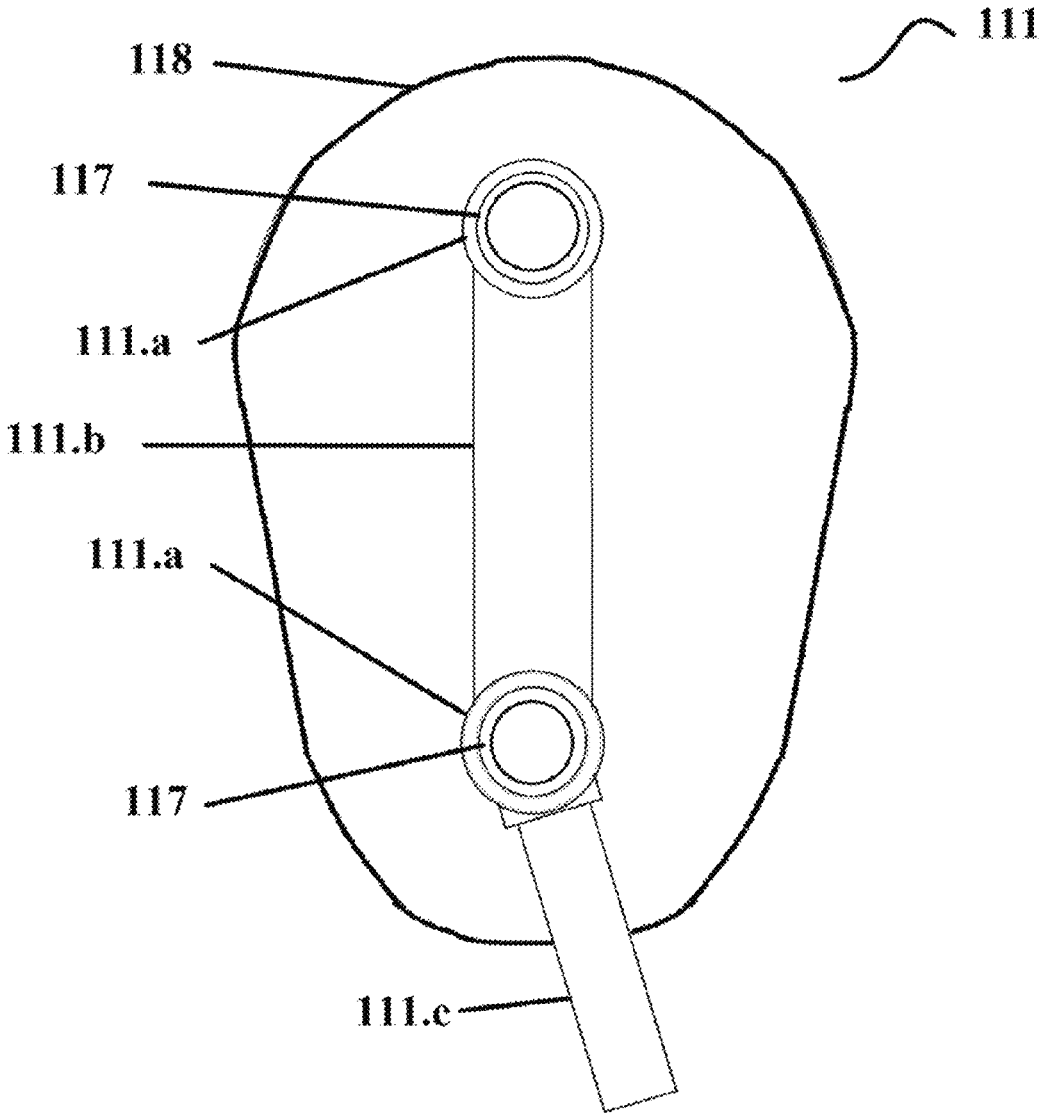
Figure 9:
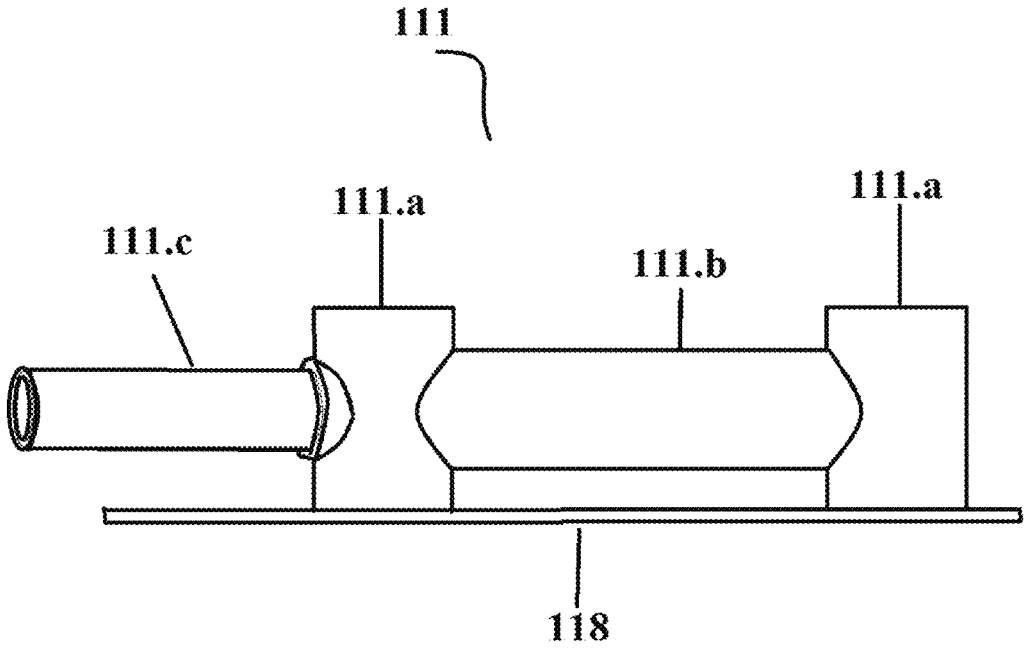

The flotation starling hull is formed with streamlined sides in the approximate shape of an ellipse or two parabola to allow the craft to move easily both in a forward and rearward direction (FIGS. 5, 6 and 7).

The flotation starling hull (FIG. 4) is made of "white water" quality material that is puncture- and abrasion-resistant. Each flotation starling may be made of multiple layer fiberglass, wood, polycarbonate, carbon fiber, polymer coated drop stitch fabric, polyurethane foam panel or inflatable high density PVC float chambers.

The starling hull has at least one water access orifice enabling the starling to at least partially fill with water and act as a ballast.

Each flotation starling control assembly has at least one major control riser post situated to connect snugly through the assembly's flotation starling(s). In a preferred embodiment, the flotation control riser posts are of sufficient length to allow stacking of multiple flotation starlings of graduated sizes and hydrodynamic shapes.

The flotation starling control assembly reduces the total craft weight and hull wetted surface area which reduces wave forces and rotational acceleration acting on the vessel chassis and frame payload platform. When used in matched pairs, the modular starling control assemblies allow the user to add and remove flotation starlings to increase and decrease total craft displacement as well as to orient the vessel's starling control assemblies to best accommodate specific load transport requirements while maintaining a stable pitch, roll, and yaw orientation for optimal performance in changing surf, current and water conditions.

The flotation starling control assembly in turn fix the struts in relation to each other and distribute flotation and load forces between the struts and the vector chassis and frame elements. In a preferred embodiment, each starling control assembly has a control bracket control riser posts and posts that connected to a tube strut assembly and allow adjustment of the bow, stern or cross brace struts to change the connecting radial angle. This permits the operator to shift the starling control assembly(s) in relation to the craft center line by inserting a different length cross brace strut or by retracting or extending an adjustable cross brace or tube strut to move the craft center of gravity fore, aft and sideways.

3. TELESCOPING TUBE STRUT ASSEMBLY. The tube strut assemblies connect to the flotation starling control bracket and are oriented radially to connect to the vector chassis and frame platform at varying angles and distances from the craft centerline. The tube strut assemblies hold the flotation starling control assemblies in place and distribute flotation and load forces between the flotation starling control assemblies and the vector chassis.

Each tube strut assembly comprises: at least one first member tube having a proximal end and a distal end forming a length there between, said proximal end securable to a starling control assembly or a chassis receiving tube; at least one second member tube having a proximal end and a distal end, said proximal end slidably insertable into said first member tube; and a locking mechanism at either end.

When one or more flotation starling control assemblies are radially connected to the vector chassis oriented outward from the craft centerline, they provide the operator the ability to control and modify the craft's OAR. The tubular frame watercraft can thereby readily have a different beam in the fore and aft section of the invention. For example, moving the two stern starling control assemblies outward of the craft centerline, increases the effective beam without increasing the craft's wetted surface. Alternately, by shortening or lengthening a strut pair that connects to the chassis, the effective overall length (LOA) is shortened or extended so as to avoid materially changing the craft's weight and/or total displacement.

Adjustment of the strut's length may be done manually, hydraulically or electronically using a mechanical screw drive with a face gear connected to a crank or a motor. A flexible material or mechanical shock absorber may also be used to provide controlled movement in one direction. The substitution of one strut with a strut of a different length or the use of an adjustable strut may be done manually.

The invention's radially oriented struts provide independent flexing which reduce rotational acceleration acting on the vector chassis, its occupant(s) and its cargo; extends the independent range of motion of the starling control assembly when compared to prior art; dampens unexpected accelerations and rotation forces by use of flexible, adjustable and shock absorbing strut assemblies; and improves the ability of emergency rescue responders to navigate turbulent water quickly and safely thereby reducing injury and loss of life due to the increased performance and maneuverability of the invention.

Bow, stern, and cross brace tubular struts consist of tubes, screw vector rods, and/or shock absorbing materials, pistons and/or springs. Each bow, stern and strut has a vector rod or tube sleeve at each end to receive and connect a strut pin to the post of either a starling control assembly or a vector chassis and frame element. This permits the operator to move the starling control assembly in relation to the craft center line and the craft center of gravity thereby controlling the vessel's attitude, its vertical, longitude and horizontal orientation, and its relation to the craft's centerline.

The strut can be located between two starling control assemblies to create a linked flotation wave control assembly pair. The cross brace strut holds the starling control assembly pair members at a fixed distance from each other. The cross brace strut provides a post or tube sleeve to receive one or more locking pins to secure the struts horizontally and vertically and to distribute flotation and load forces.

The cross brace strut reduces the stresses on the joints connecting the struts to the vector chassis and bridge element. Adjustment of the strut may be done manually, hydraulically, electronically, or mechanically using a screw drive with a face gear connected to a motor. In a preferred embodiment, one or more adjustable cross brace struts connect one or more pairs of starling control assembly by use of a collar and strut connecting post that allows user adjustment of the bow, stern or cross brace strut to vary the radial angle from narrow to wide. Varying the angular separation and length of each pair of struts adjusts the width of the beam and overall length of the variable aspect surf rescue boat which increases or decreases the craft stability and risk of capsize. Separating and actively modifying a craft's flotation displacement and aspect ratio control from the watercraft superstructure provides for infinite new possibilities in variable aspect surf rescue boat, physical training, recreation, commercial and military watercraft design.

In certain embodiments, the invention provides a method to inject or remove water or other liquid into and from of the flotation starlings to offer the operator independent and dynamic displacement options not available in prior art variable aspect surf rescue boat. For example, if the bow flotation assembly pair has traversed a large incoming wave blocking the vessel's direction of travel, the pair could be filled with fluid then the extended bow telescoping tube struts could be retracted to assist the operator to pull the variable aspect surf rescue boat through the wave then the fluid could be moved to the stern starling control assembly pair and the bow struts extended again.

4. PROPULSION & CONTROL ASSEMBLY comprises one or more mounts and one or more of the following propulsion methods: a rowing rail; a sail with mast; a mechanical motor with air or water propeller(s); and/or a water or air jet pump. Each mount is connected securely to the chassis and frame platform and/or the stern support frame, posts, deck frame, grate and/or payload cage by means of one or more backing plates, connectors and marine hardware.

Figure 10:
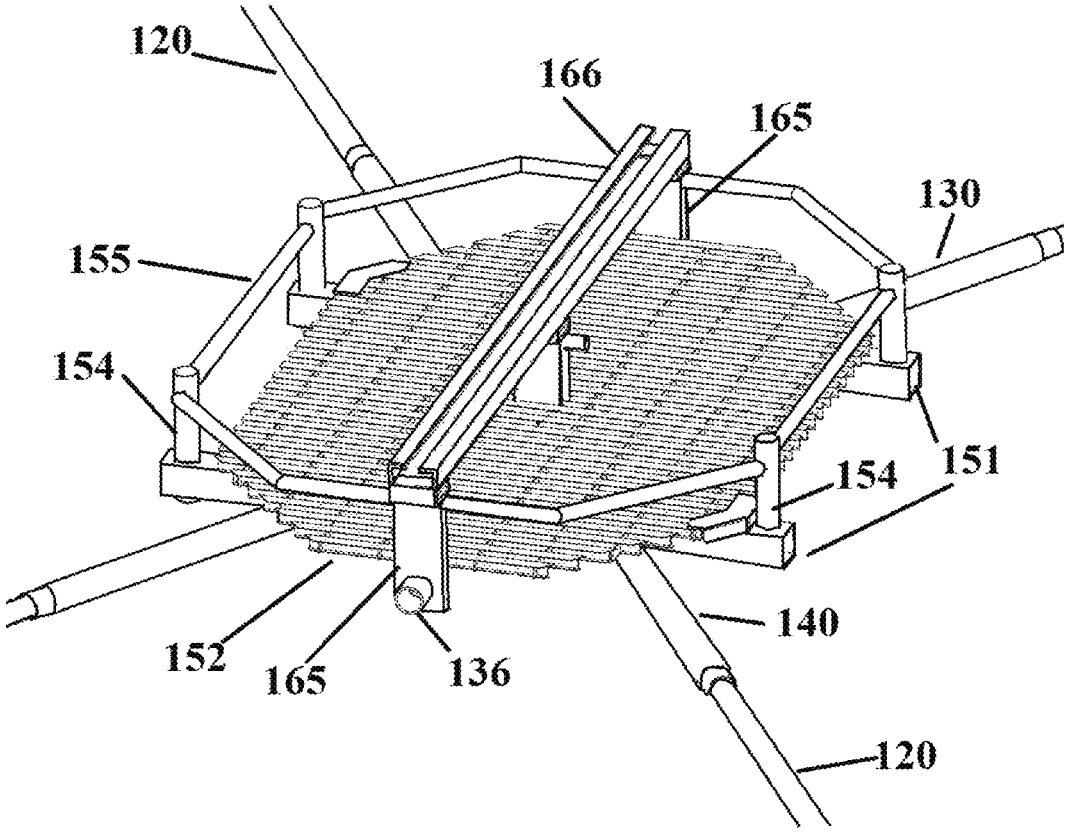
Figure 11:
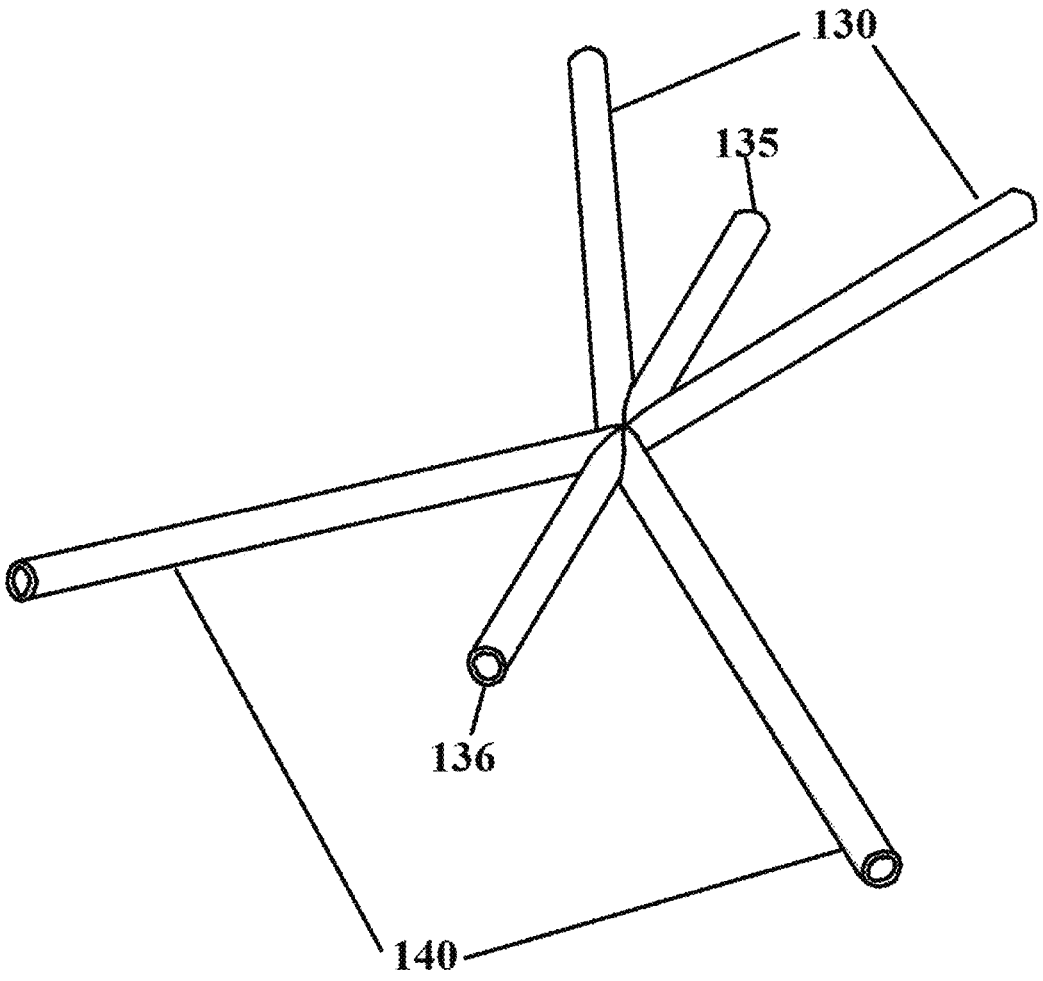
FIG. 11 shows the perspective view from above the stern of a vector chassis for a quad-vector variable aspect surf rescue boat including twin bow chassis tubes (130), twin stern chassis tubes (140), and the central, bow chassis spine tube (135) and stern chassis spine tube (136).
Figure 12:
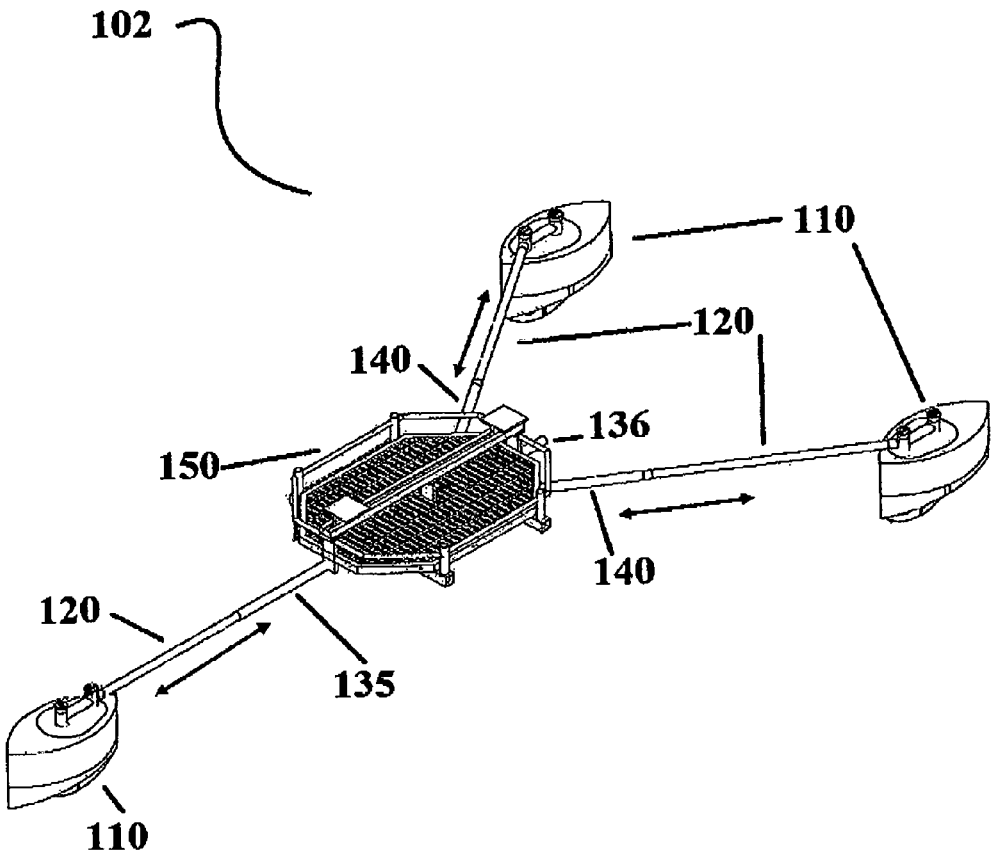
FIG. 12 illustrates a perspective view of the second preferred embodiment from above the port bow of an open frame, tubular tri-vector strut variable aspect surf rescue boat (102) using a rowing rail propulsion assembly. The Tri-Vector chassis connects the single bow starling control assembly (110) and pair of stern starling control assemblies (110) to the chassis and frame payload platform assembly (150) by three telescoping tubular struts (120). The telescoping tubular struts (120) optionally slide inside the twin stern chassis tubes (140), and the bow chassis spine tube (135). The rowing assembly is connected to the bow and stern chassis spine tubes (135, 136).
Figure 13:
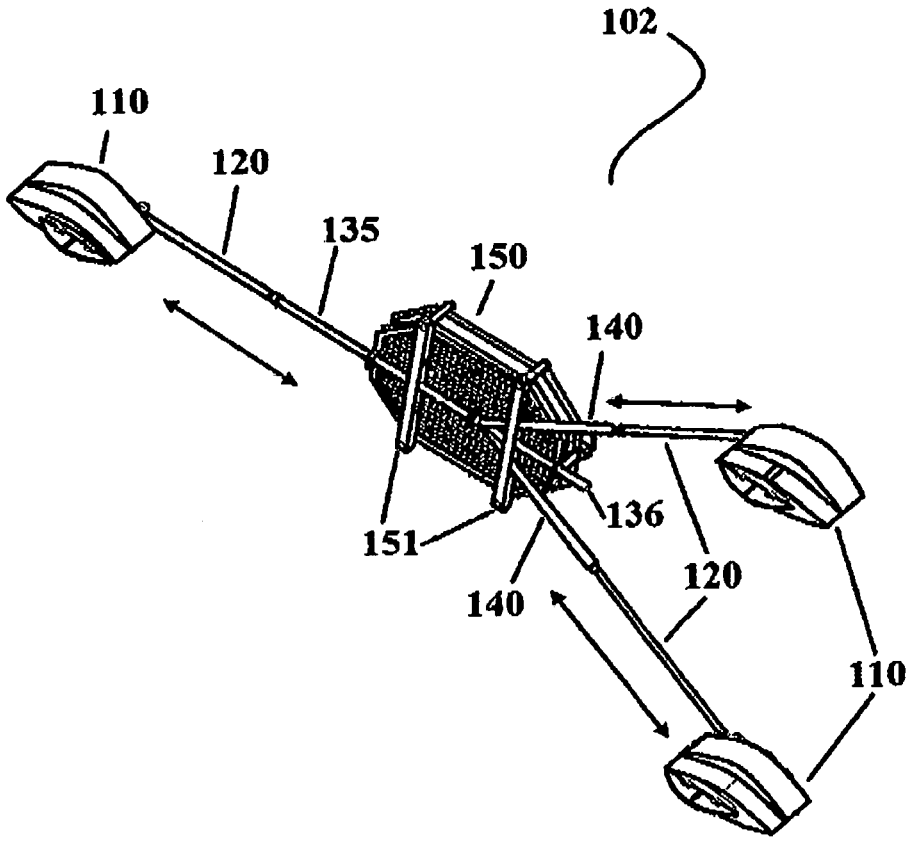
FIG. 13 shows a bottom perspective view of FIG. 12, a tri-vector strut variable aspect surf rescue boat (102), assembled with three starling control assemblies (110), three telescoping tubular struts (120), bow chassis spine tube (135), stern chassis spine tube (136), twin box beams (151), twin stern chassis tubes (140), the chassis and frame payload platform assembly (150) and rowing rail propulsion assembly.
Figure 14:
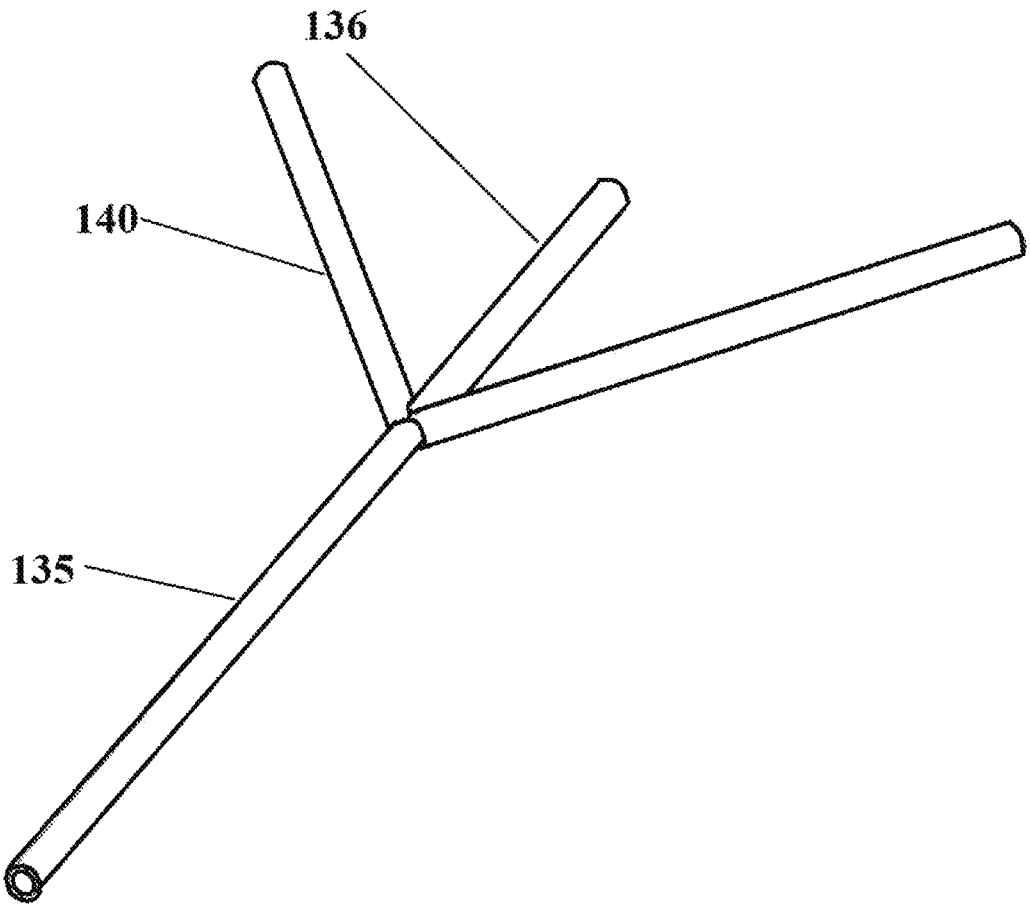
FIG. 14 shows a perspective view from above the port bow of a tri-vector surfboat chassis consisting of a bow chassis spine tube (135), stern chassis spine tube (136) and matching pair of twin stern chassis tubes (140).

In a preferred embodiment, a rowing rail propulsion assembly is mounted between the bow and stern bridge posts (FIGS. 10, 11 and 12). A seat and an oar rig are mounted on wheeled trucks that ride on one or more parallel rails connecting the bow and stern and use one or more locking pins to immobilize one or both trucks. When not secured and immobilized with a locking pin, the wheels of the seat and oar rigging trucks roll securely and freely within the box rail. The rail and truck system (FIGS. 15 and 17) comprises:

a) One or more rowing box rails (166) connected to the bow, stern, and or transom.

b) Two trucks (164) with a base platform and one or more wheel pairs that ride on the rails described above.

c) One truck (164) carries the oar rigs (161) in a selected orientation with respective to the rail.

A second sliding truck (164) carries the rowing seat (162) in a selected orientation with respective to the rail.

Locking pin slots are made in the rails and in both trucks for insertion of the locking pin. Locking pins of sufficient length and circumference are inserted by the user to immobilize the truck selected.

The rowing apparatus portion of this invention is different and unique in that it eliminates excess hull weight and provides the user with the option to choose a combination of seat and oar rigging configurations. This invention permits selection among the following alternate rowing apparatus configurations using a rail and truck:

1. Fixed oar riggers with a sliding seat,
2. Fixed seat with sliding oar riggers,
3. Fixed oar riggers with fixed seat.

To select the rowing configuration desired, the user slides a truck so that the truck's locking pin slot is in line with the desired rail locking pin slot location. The user then inserts a locking pin through both the truck base continuing through the rail(s) to lock in place either the seat, the oar rigging, both or neither at a desired rail location as required. By providing rail locking pin slots at multiple locations on the rail(s), the seat and oar rigging can be adjusted for various user heights and physiques.

In conclusion, the proposed invention, a multi-hull, variable aspect ratio variable aspect surf rescue boat is an improvement over prior art and is:

safely launched in rip current, high wave and turbulent water conditions;
resistant to capsize and swamping;
maneuverable in deep and shallow waters;
transportable by hand over irregular terrain;
quickly assembled on a beach by a user;
major components are interchangeable on multiple crafts;
energy efficient;
adaptable to both manual and powered propulsion It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to be secure by Letter Patent is:

1. A multi-hull variable aspect surf rescue boat comprising:

a) a frame assembly having a frame centerline strut and at least three telescoping tubular struts which radiate from the frame centerline strut fore and aft, wherein each telescoping tubular strut comprises a first member tube and a second member tube extending telescopically from the first member tube, and further wherein the first member tubes of the telescoping tubular struts and the frame centerline strut are formed as fixed bow, stern and spine receiving tubes that intersect permanently at a center line of the boat;

b) three or more starling control assemblies, wherein each starling control assembly is attached to a respective one of the three telescoping tubular struts of the frame assembly and is made of tubes, brackets and at least one starling float hull that is streamlined symmetrically fore and aft;

c) a payload platform made of a deck and cage affixed to the frame assembly that form an enclosure to contain and support occupants and/or payload;

d) a means of propulsion attached to the frame assembly and configured to transport said occupants and/or payload in surf or turbulent waterways.

2. The multi-hull variable aspect surf rescue boat as recited in claim 1, further comprising a double elliptical ring cage supporting said deck and connected to the frame assembly.

3. The multi-hull variable aspect surf rescue boat as recited in claim 1, wherein the telescoping tubular struts are constructed in the form of an arch that may be extended or retracted independently to change the boat's OAR, overall length, and/or beam on center.

4. The multi-hull variable aspect surf rescue boat as recited in claim 1, wherein the telescoping tubular struts may be extended or retracted independently by use of a mechanical linear actuator that uses gears and motors to change the boat's OAR, overall length and/or beam on center.

5. The multi-hull variable aspect surf rescue boat as recited in claim 1, wherein the telescoping tubular struts may be extended or retracted independently by use of a hydraulic pump actuating hydraulic piston and tubing to change the boat's OAR, overall length, and/or beam on center.

6. The multi-hull variable aspect surf rescue boat as recited in claim 1, wherein the telescoping tubular struts may be manually replaced to vary the boat's OAR, overall length, and/or beam on center.

7. The multi-hull variable aspect surf rescue boat as recited in claim 1, wherein the at least one starling float hull of one or more of the starling control assemblies comprises at least one water access orifice and water pump enabling said one or more of the starling control assemblies to at least partially fill and empty with water and to act as ballast sufficient to modify the vessel's center of buoyancy, center of gravity, metacenter and its resulting righting moment.

8. The multi-hull variable aspect surf rescue boat as recited in claim 1, wherein said means of propulsion comprises a rowing propulsion assembly for oar rowing having a rail mounted on trestle posts that connect to the frame assembly and to the payload platform.

* * * * *